US007677009B2

(12) United States Patent
Bowman

(10) Patent No.: US 7,677,009 B2
(45) Date of Patent: Mar. 16, 2010

(54) ROOF TRUSS SYSTEM

(75) Inventor: Jay J. Bowman, Florence, KY (US)

(73) Assignee: NOVA Chemicals Inc., Moon Township, PA (US)

( * ) Notice: Subject to any disclaimer, the term of this patent is extended or adjusted under 35 U.S.C. 154(b) by 478 days.

(21) Appl. No.: 11/701,584

(22) Filed: Feb. 2, 2007

(65) Prior Publication Data

US 2008/0184651 A1 Aug. 7, 2008

(51) Int. Cl.
*E04B 1/32* (2006.01)

(52) U.S. Cl. ..... 52/641; 52/309.7; 52/645

(58) Field of Classification Search ..... 52/309.7, 52/309.16, 641, 645, 66, 91.3
See application file for complete search history.

(56) References Cited

U.S. PATENT DOCUMENTS 2,642,825 A * 6/1953 Mcelhone et al. ..... 52/641
2,983,692 A 5/1961 D'Alelio
3,023,175 A 2/1962 Rodman, Jr.
3,722,171 A * 3/1973 Godley ..... 52/745.13
3,760,550 A * 9/1973 Mueller et al. ..... 52/641
4,094,110 A 6/1978 Dickens et al.
4,241,555 A 12/1980 Dickens et al.
4,245,439 A * 1/1981 Flaba ..... 52/71
4,250,674 A 2/1981 Feist
4,267,135 A 5/1981 Stroud et al.
4,268,236 A 5/1981 Peille
4,303,756 A 12/1981 Kajimura et al.
4,303,757 A 12/1981 Kajimura et al.
4,332,754 A 6/1982 Meunier et al.
4,348,164 A 9/1982 Fujii et al.
4,354,810 A 10/1982 Stidham
4,376,741 A 3/1983 Stenzel
4,379,107 A 4/1983 Berner (Continued)

FOREIGN PATENT DOCUMENTS

DE 203 16 376 U1 2/2004

(Continued)

OTHER PUBLICATIONS

ELFI Wall System, http://elfiwallsystem.com/index.htm, 2003.

(Continued)

*Primary Examiner*—David Dunn
*Assistant Examiner*—Joshua Ihezie
(74) *Attorney, Agent, or Firm*—Gary F. Matz

(57) ABSTRACT

An adjustable roof truss that includes roof truss members, roof base members and a central body containing a polymer matrix. The roof truss members include a pivot end, a connection end, a roof facing edge, an inside edge, and a pivot surface. The roof base members include a receiving end, a connecting end, a top edge, a bottom edge, and a contact surface. The roof truss members are pivotally connected to the roof base members by a pivot fastener inserted through a pivot opening on the roof base members and a stator opening on the roof truss members. One or both of the roof truss members and the roof base members include an embedded portion extending from the roof facing edge or the bottom edge respectively into the central body. Expansion hole(s) are positioned along the embedded portion such that the polymer matrix expands through the expansion holes.

18 Claims, 16 Drawing Sheets

U.S. PATENT DOCUMENTS

| | | | | |
|---|---|---|---|---|
| 4,382,759 | A | 5/1983 | Vassalli | |
| 4,399,086 | A | 8/1983 | Walter | |
| 4,412,961 | A | 11/1983 | DiBiasi et al. | |
| 4,447,382 | A | 5/1984 | Spurlock et al. | |
| 4,485,059 | A | 11/1984 | Krutchen et al. | |
| 4,486,369 | A | 12/1984 | Schafler et al. | |
| 4,487,731 | A | 12/1984 | Kobayashi | |
| 4,489,023 | A | 12/1984 | Proksa | |
| 4,492,664 | A | 1/1985 | Bruno | |
| 4,498,660 | A | 2/1985 | Brema et al. | |
| 4,504,429 | A | 3/1985 | Griffiths | |
| 4,507,255 | A | 3/1985 | Shizawa | |
| 4,518,550 | A | 5/1985 | Miettinen et al. | |
| 4,530,806 | A | 7/1985 | Melchior | |
| 4,551,958 | A | 11/1985 | Reneault et al. | |
| 4,559,003 | A | 12/1985 | Poncet | |
| 4,564,487 | A | 1/1986 | Bennett | |
| 4,567,008 | A | 1/1986 | Griffiths | |
| 4,572,865 | A | 2/1986 | Gluck et al. | |
| 4,581,186 | A | 4/1986 | Larson | |
| 4,585,603 | A | 4/1986 | Furuta et al. | |
| 4,607,061 | A | 8/1986 | Schmidt | |
| 4,641,468 | A | 2/1987 | Slater | |
| 4,653,718 | A | 3/1987 | Dickens | |
| 4,666,393 | A | 5/1987 | Kumasaka et al. | |
| 4,685,872 | A | 8/1987 | Erlenbach | |
| 4,756,860 | A | 7/1988 | Hooper et al. | |
| 4,761,256 | A | 8/1988 | Hardenbrook et al. | |
| 4,783,287 | A | 11/1988 | Eichberger et al. | |
| 4,832,885 | A | 5/1989 | Gross | |
| 4,911,628 | A | 3/1990 | Heilmayr et al. | |
| 4,953,334 | A | 9/1990 | Dickens | |
| 4,956,133 | A | 9/1990 | Payne | |
| 4,976,075 | A * | 12/1990 | Kaveckis et al. | 52/71 |
| 4,981,427 | A | 1/1991 | Prignitz | |
| 5,067,298 | A | 11/1991 | Petersen | |
| D323,222 | S | 1/1992 | Roland | |
| 5,087,185 | A | 2/1992 | Yada et al. | |
| 5,142,838 | A * | 9/1992 | Simpson et al. | 52/640 |
| 5,187,905 | A | 2/1993 | Pourtau et al. | |
| 5,229,138 | A | 7/1993 | Carotti | |
| 5,333,429 | A | 8/1994 | Cretti | |
| 5,375,988 | A | 12/1994 | Klahre | |
| 5,388,975 | A | 2/1995 | Proksa et al. | |
| 5,411,389 | A | 5/1995 | Kellerhof et al. | |
| 5,414,972 | A * | 5/1995 | Ruiz et al. | 52/600 |
| D360,700 | S | 7/1995 | Myers et al. | |
| 5,457,927 | A * | 10/1995 | Pellock et al. | 52/633 |
| 5,474,722 | A | 12/1995 | Woodhams | |
| 5,505,031 | A | 4/1996 | Heydon | |
| 5,505,599 | A | 4/1996 | Kemerer et al. | |
| 5,512,222 | A | 4/1996 | Sabol et al. | |
| D373,836 | S | 9/1996 | Bado et al. | |
| 5,553,961 | A | 9/1996 | Olden | |
| 5,582,840 | A | 12/1996 | Pauw et al. | |
| 5,587,182 | A | 12/1996 | Sulzbach et al. | |
| 5,620,710 | A | 4/1997 | Fiorentini et al. | |
| 5,629,027 | A | 5/1997 | Fiorentini et al. | |
| 5,639,483 | A | 6/1997 | Fiorentini et al. | |
| 5,649,403 | A * | 7/1997 | Haisch | 52/693 |
| 5,665,286 | A | 9/1997 | Sulzbach et al. | |
| 5,665,287 | A | 9/1997 | Fiorentini et al. | |
| 5,678,369 | A * | 10/1997 | Ishikawa et al. | 52/309.9 |
| 5,704,170 | A * | 1/1998 | Simpson | 52/90.1 |
| 5,749,960 | A | 5/1998 | Belyayev | |
| 5,784,850 | A | 7/1998 | Elderson | |
| 5,787,665 | A | 8/1998 | Carlin et al. | |
| 5,792,481 | A | 8/1998 | Cretti | |
| 5,798,064 | A | 8/1998 | Peterson | |
| D399,010 | S | 9/1998 | Current | |
| 5,804,113 | A | 9/1998 | Blackwell et al. | |
| 5,809,725 | A | 9/1998 | Cretti | |
| 5,822,940 | A | 10/1998 | Carlin et al. | |
| D401,361 | S | 11/1998 | Mitchell | |
| 5,844,015 | A | 12/1998 | Steilen et al. | |
| 5,857,292 | A * | 1/1999 | Simpson | 52/22 |
| D406,360 | S | 3/1999 | Finkell, Jr. | |
| 5,893,248 | A * | 4/1999 | Beliveau | 52/309.7 |
| D411,628 | S | 6/1999 | Dyer | |
| 5,945,048 | A | 8/1999 | Ensinger | |
| D414,275 | S | 9/1999 | Azar | |
| 5,966,885 | A | 10/1999 | Chatelain | |
| 5,983,589 | A * | 11/1999 | Daudet | 52/640 |
| D418,926 | S | 1/2000 | Owens et al. | |
| D419,697 | S | 1/2000 | Kroesbergen | |
| 6,021,618 | A | 2/2000 | Elderson | |
| D422,094 | S | 3/2000 | Wolfrum | |
| 6,036,898 | A | 3/2000 | Sulzbach et al. | |
| RE36,674 | E | 4/2000 | Gluck et al. | |
| 6,045,350 | A | 4/2000 | Cretti | |
| 6,098,367 | A | 8/2000 | Fridman et al. | |
| 6,119,418 | A | 9/2000 | Johnson | |
| 6,127,439 | A | 10/2000 | Berghmans et al. | |
| 6,147,133 | A | 11/2000 | Sulzbach et al. | |
| 6,160,027 | A | 12/2000 | Crevecoeur et al. | |
| RE37,012 | E | 1/2001 | Fiorentini et al. | |
| 6,167,624 | B1 * | 1/2001 | Lanahan et al. | 29/897.32 |
| RE37,075 | E | 2/2001 | Fiorentini et al. | |
| D437,644 | S | 2/2001 | Russo | |
| RE37,115 | E | 3/2001 | Fiorentini et al. | |
| 6,202,375 | B1 | 3/2001 | Kleinschmidt | |
| 6,206,669 | B1 | 3/2001 | Lewit et al. | |
| D440,327 | S | 4/2001 | Keating et al. | |
| 6,226,943 | B1 | 5/2001 | Grinshpun et al. | |
| 6,235,367 | B1 | 5/2001 | Holmes et al. | |
| 6,242,540 | B1 | 6/2001 | Crevecoeur et al. | |
| 6,264,734 | B1 | 7/2001 | Dickens | |
| 6,272,749 | B1 | 8/2001 | Boeshart et al. | |
| D449,392 | S | 10/2001 | Kulik | |
| 6,298,622 | B1 * | 10/2001 | Cretti | 52/309.7 |
| 6,301,854 | B1 | 10/2001 | Daudet et al. | |
| 6,322,651 | B1 | 11/2001 | Phelps | |
| 6,350,308 | B1 | 2/2002 | Dickens | |
| D455,843 | S | 4/2002 | Albany et al. | |
| 6,385,942 | B1 | 5/2002 | Grossman et al. | |
| 6,401,422 | B1 | 6/2002 | Olden | |
| 6,412,243 | B1 | 7/2002 | Sutelan | |
| 6,418,687 | B1 | 7/2002 | Cox | |
| 6,444,073 | B1 | 9/2002 | Reeves et al. | |
| 6,481,178 | B2 | 11/2002 | Moore, Jr. | |
| 6,494,012 | B2 * | 12/2002 | Seng | 52/841 |
| D469,885 | S | 2/2003 | Zen | |
| D470,602 | S | 2/2003 | Pate | |
| 6,531,077 | B1 | 3/2003 | Flarup-Knudsen | |
| 6,537,054 | B2 | 3/2003 | Kitahama et al. | |
| 6,584,736 | B2 | 7/2003 | Szymanski et al. | |
| 6,634,152 | B1 | 10/2003 | Pilkinton | |
| 6,647,675 | B1 * | 11/2003 | Castellanos | 52/198 |
| 6,655,944 | B2 | 12/2003 | Massarotto et al. | |
| 6,662,503 | B2 | 12/2003 | Cowell et al. | |
| D487,317 | S | 3/2004 | Guertin | |
| 6,701,684 | B2 | 3/2004 | Stadter | |
| 6,708,460 | B1 | 3/2004 | Elderson | |
| D493,545 | S | 7/2004 | Lancia et al. | |
| D494,284 | S | 8/2004 | Wenrick et al. | |
| 6,796,093 | B2 * | 9/2004 | Brandes | 52/309.8 |
| 6,833,095 | B2 | 12/2004 | Sulzbach et al. | |
| 6,854,230 | B2 | 2/2005 | Starke | |
| 6,898,908 | B2 | 5/2005 | Messenger et al. | |
| 6,908,949 | B2 | 6/2005 | Arch et al. | |
| 6,963,487 | B2 | 11/2005 | Billington et al. | |
| 7,138,077 | B2 | 11/2006 | Ehbing et al. | |
| 2001/0009683 | A1 | 7/2001 | Kitahama et al. | |
| 2002/0059774 | A1 * | 5/2002 | Collins | 52/690 |

| | | | | |
|---|---|---|---|---|
| 2002/0069602 | A1* | 6/2002 | Blanchet | 52/600 |
| 2002/0117769 | A1 | 8/2002 | Arh et al. | |
| 2002/0184846 | A1* | 12/2002 | Crowder | 52/507 |
| 2003/0079438 | A1 | 5/2003 | Stephens et al. | |
| 2003/0085483 | A1 | 5/2003 | Kroeger | |
| 2004/0096642 | A1 | 5/2004 | Maruyama et al. | |
| 2004/0154257 | A1 | 8/2004 | Kawai et al. | |
| 2004/0194396 | A1* | 10/2004 | Shanni | 52/79.5 |
| 2004/0202742 | A1 | 10/2004 | Winter | |
| 2005/0034401 | A1 | 2/2005 | Sutelan et al. | |
| 2005/0055973 | A1* | 3/2005 | Hagen et al. | 52/741.1 |
| 2005/0086906 | A1 | 4/2005 | Bathon et al. | |
| 2005/0242626 | A1 | 11/2005 | Preisler et al. | |
| 2005/0281999 | A1 | 12/2005 | Hofmann et al. | |
| 2006/0191232 | A1* | 8/2006 | Salazar et al. | 52/606 |
| 2006/0201090 | A1* | 9/2006 | Guevara et al. | 52/309.12 |
| 2006/0251851 | A1* | 11/2006 | Bowman | 428/71 |
| 2006/0280013 | A1 | 12/2006 | Spinelli | |
| 2008/0057290 | A1* | 3/2008 | Guevara et al. | 428/312.4 |
| 2008/0222989 | A1* | 9/2008 | Greeff et al. | 52/641 |

FOREIGN PATENT DOCUMENTS

| | | | |
|---|---|---|---|
| EP | 0 459 924 | A1 | 12/1991 |
| EP | 0 464 008 | B1 | 2/1995 |
| EP | 0 693 597 | B1 | 1/1996 |
| WO | WO 02/20916 | A1 | 3/2002 |
| WO | WO 02/35020 | A2 | 5/2002 |
| WO | WO 2004/009929 | A1 | 1/2004 |
| WO | WO 2004/101905 | A1 | 11/2004 |

OTHER PUBLICATIONS

Stoam Industries, Product Brochure, at least earlier than February Feb. 24, 2006.

Plastbau Technology—Insul-Deck, "Lightweight Forming System for Concrete Floors and Roofs", Product Brochure, Cat. No. 5M2, 2002.

Sicilferro, "Tecnova—Tecnologie Costruttive", PRoduct Catalog, at lease earlier than Feb. 24, 2006.

* cited by examiner

ROOF TRUSS SYSTEM

BACKGROUND OF THE INVENTION

1. Field of the Invention

The present invention is directed to structural members for use in building construction and in particular to roof truss systems for construction of roof framing for supporting roofs.

2. Description of the Prior Art

A truss is a generally rigid frame member designed to support a structure, such as a roof or a floor. Trusses come in many shapes and sizes for a variety of applications.

The building of roof trusses on the building site in residential and in small commercial buildings is an expensive and time-consuming operation. In addition, where a large number of such trusses need be built, they rarely turn out to be perfectly uniform. As a result, the building industry has gone to the prefabricated roof truss, which eliminates the costly on-site labor time.

Roof trusses for commercial and residential buildings are typically prefabricated using wooden beams and metal joiner plates. Such prefabricated structures are large and heavy and must be shipped from the factory to the building site in small numbers on a large truck. However, shipping height and width restrictions can impose constraints on truss geometry, particularly where the trusses are to be shipped via a public highway system.

As a result of shipping height and width restrictions, it is common for truss designers to design many trusses as "piggy-backs," which include small portions of the overall truss design and are more easily transported to the construction site. Once the piggy-back trusses are received at the building site, they are usually mounted on top of each other to obtain the desired roof geometry. When piggy-back trusses are used, special field framing and bracing is typically required to ensure that loads are properly transferred and structural stability is maintained. Although piggy-back trusses solve many problems encountered when shipping the trusses to the construction site, such truss arrangements typically result in additional material handling and set up costs which increase building construction costs.

An alternative to piggy-back trusses is to fabricate the trusses with one or more hinge assemblies to connect the structural members which form the trusses and, thus, render the truss collapsible for shipping purposes.

U.S. Pat. No. Ser. 5,553,961 discloses a hinge for use in connecting two coplanar wooden structural members of a wooden truss structure enabling folding of the structure to reduce its height for transport over the road. The hinge includes two pivotally interconnected plates each having teeth for nailing, them to the wooden members and one having fingers for engagement with a surface of a wooden member for accurate alignment.

U.S. Pat. No. 6,401,422 discloses a hinge connector for interconnection of disconnected truss members. The connector includes an elongate sheet metal plate having nailing teeth adapted to be driven into a truss member for permanently attaching it to one member. The truss can be collapsed and transported to the building site with the truss members disconnected.

The hinge assemblies set forth in these U.S. Patents are primarily for use with wooden trusses and are not well suited for trusses formed from, for example, steel or other metal materials.

U.S. Pat. No. 3,760,550, discloses a collapsible truss structure where the truss structure may be formed of steel channel members. Bolted arrangements are provided for pivotably and slidably connecting the members that form the truss.

U.S. Pat. No. 6,634,152 discloses a jackknife foldable roof truss including left and right heel sections, a jackknife foldable peak section and a center bottom chord.

Such arrangements are generally not cost effective to transport, manufacture and install. Thus, a hinged roof truss assembly that provides desired structural strength while reducing transportation, material handling and set up costs resulting in decreased building construction costs would be desirable.

SUMMARY OF THE INVENTION

The present invention provides an adjustable composite roof truss that includes one or more roof truss members and one or more roof base members. The one or more roof truss members include a pivot end, a connection end, a roof facing edge, an inside edge, and a pivot surface. The one or more roof base members include a receiving end, a connecting end, a top edge, a bottom edge, and a contact surface. The roof truss members are pivotally connected to the roof base members by a pivot fastener inserted through a pivot opening positioned between a midpoint and the receiving end along the contact surface of the roof base members and a stator opening located between a midpoint and the pivot end of the roof truss members of the roof base members. One or both of the roof truss members and the roof base members include an embedded portion extending from the roof facing edge or the bottom edge, respectively, such that the embedded portion longitudinally extends across and into a central body, substantially parallelepipedic in shape, that contains an expanded polymer matrix, having opposite faces, a first surface and an opposing second surface. One or more expansion holes are positioned along the embedded portion between the first surface and the second surface of the central body such that the polymer matrix expands through the expansion holes.

The present invention also provides a method of constructing a building that includes providing a slab or foundation having a series of walls extending therefrom, the walls including a top surface; and attaching the above-described roof truss system to the top surfaces.

The present invention further provides buildings that include the above-described roof truss system and/or are constructed according to the above-described method.

DETAILED DESCRIPTION OF THE INVENTION

Figure 1:
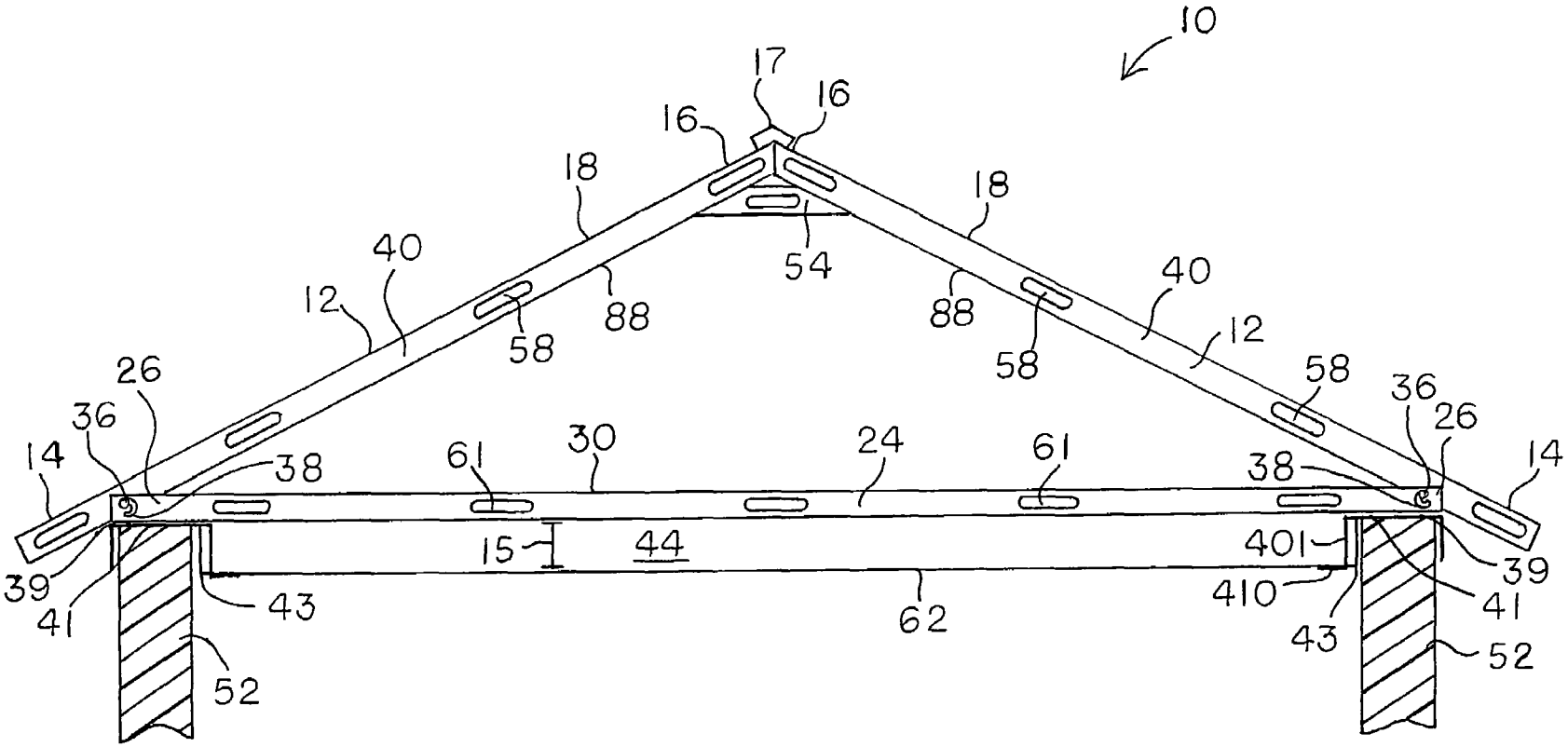
FIG. 1 is a front elevation view of a roof truss system according to the invention.
Figure 2:
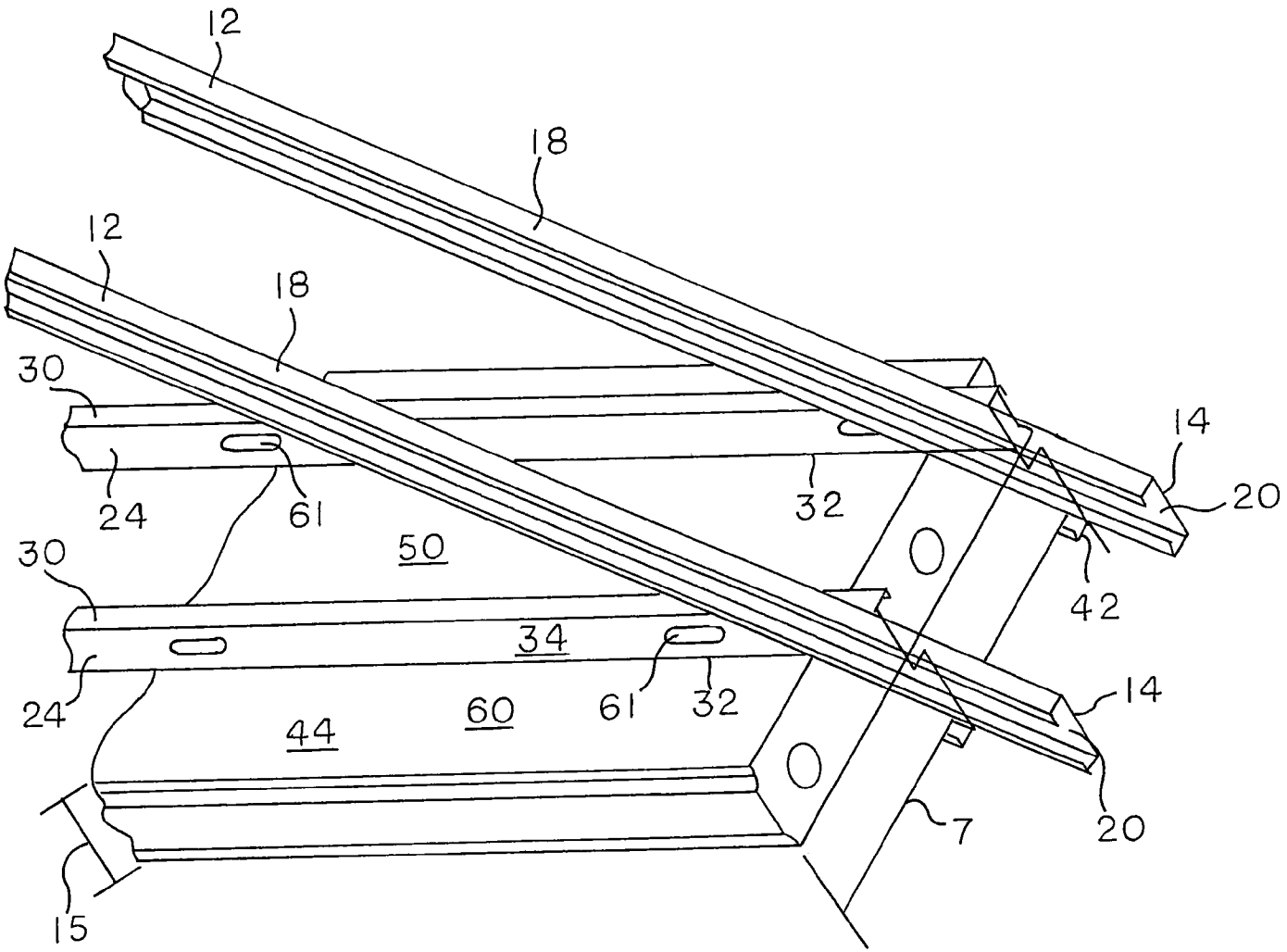
FIG. 2 is a partial perspective view of a roof truss system according to the invention.

For the purpose of the description hereinafter, the terms "upper", "lower", "inner", "outer", "right", "left", "vertical", "horizontal", "top", "bottom", and derivatives thereof, shall relate to the invention as oriented in the drawing Figures. However, it is to be understood that the invention may assume alternate variations and step sequences except where expressly specified to the contrary. It is also to be understood that the specific devices and processes, illustrated in the attached drawings and described in the following specification, is an exemplary embodiment of the present invention. Hence, specific dimensions and other physical characteristics related to the embodiment disclosed herein are not to be considered as limiting the invention. In describing the embodiments of the present invention, reference will be made herein to the drawings in which like numerals refer to like features of the invention.

Other than in the operating examples or where otherwise indicated, all numbers or expressions referring to quantities of ingredients, reaction conditions, etc. used in the specification and claims are to be understood as modified in all instances by the term "about". Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

As used herein, the term "polymer" is meant to encompass, without limitation, oligomers, homopolymers, copolymers and graft copolymers.

As used herein the term "thermoplastic" refers to polymeric and/or resinous materials and adjuvants and/or additives mixed therein that can be shaped by applying heat and/or pressure and that can be repeatedly softened by heating and hardened again on cooling.

Unless otherwise specified, all molecular weight values are determined using gel permeation chromatography (GPC) using appropriate polystyrene standards. Unless otherwise indicated, the molecular weight values indicated herein are weight average molecular weights (Mw).

Unless otherwise specified, the term "truss" refers to a generally rigid frame member designed to support a structure, such as a roof or a floor. The term "truss system" refers to a plurality of connected trusses designed to support a structure.

As used herein, the term "truss panel" refers to a body containing an expanded polymer matrix having a portion of a truss embedded therein.

As used herein, the term "fastener" refers to items, articles, means and/or methods of securely attaching one or more items or articles to one or more other items or articles and include without limitation pins or pinning, tying, nails or nailing, buttoning, locking, screws or screwing, bolts with or without the use of nuts, connecting or uniting by a bond or link such as by welding, gluing, or applying adhesive, or otherwise securing two or more articles or items together.

Various embodiments of the present invention provide preformed building panels that include one or more reinforcing structural elements or members running longitudinally, which are partially exposed, with the remainder of the reinforcing structural element(s) partially encapsulated in a body containing an expanded polymer matrix, which acts as a thermal break. The reinforcing structural elements can be flanged lengthwise on either side to provide attachment points for external objects to the panel. Openings in the reinforcing structural elements which are encapsulated in the expanded polymer matrix allow for fusion perpendicularly. Perforations in the exposed portion of the reinforcing structural element provide attachment points for lateral bracing and utility installation. In some embodiments, a tongue and groove connection point design provides for panel abutment. In some embodiments, longitudinal holes can be provided through the expanded polymer matrix to provide areas or channels for the placement of utilities and/or the venting of gasses. Such construction also serves to reduce the overall weight of the panels. The longitudinal holes can be variable in diameter and location. Panel manufacture can be accomplished through the use of a semi-continuous or continuous molding process allowing for variable panel lengths.

The composite building panels of the present invention will now be discussed in terms of embodiments providing roof truss panels and roof truss systems. However, one skilled in the art would understand that the composite building panels of the present invention can be used for a variety of uses, such as will be discussed in detail below. Therefore, the following discussion regarding roof truss panels and roof truss systems is not intended to limit the scope of the present invention.

The present invention is directed to an engineered lightweight, insulated, panelized roof truss design that is fully collapsible for transportation, that easily scissors into position and is erected with fewer fasteners than prior art truss designs. The insulated panel and framing members are reversible to allow for flexibility of design and advantages in positioning of the insulated portion of the truss panel.

In more specific terms, the invention provides a molded expanded polymer matrix panel roof truss design that simplifies the job site installation of trusses and eliminates several steps in the roof framing and insulating process. In embodiments of the invention, the truss design incorporates the light weight and high strength of light gauge steel framing with the insulating properties of an expanded polymer matrix, produced using a unique continuous or semi continuous molding process for expandable polymers. The expanded polymer matrix portion of the truss panel fixes in place the light gauge structural framing members and provides the required insulation of the final building design. The finished truss sections are collapsible for the economical transportation of the truss to a job site location.

As indicated above, wood and light gauge steel truss design are used extensively within the building industry. However, wood is known to be very susceptible to the damaging effects of weathering as well as damage from various insects. Common problems observed with wood include warping, splitting, loss of connector strength and water absorption adding to the installed weight of a wooden truss. On a common construction site there is normally no storage area that can adequately protect wooden trusses that are not immediately installed. Normally the weight of a wood truss will require the use of a crane and elaborate temporary blocking to locate and safely position the truss in its final location.

Light gauge steel or construction grade plastic truss designs are less susceptible to the damaging effect of weathering or insects over time, and hold their dimensions to a greater degree than wood design truss systems. Light gauge steel is one of the strongest materials by weight used in the framing of construction projects. However, there are several problems associated with the use of light gauge steel framing members. Steel framing is complex to assemble and cut in the field and requires the use of many more specially designed fasteners when compare to wooded framing members. The high thermal transmission rate of light gauge steel members requires the use of extra insulation and more complex designs to obtain the same thermal values associated with equivalent wood framing members. The lack of structural integrity during the framing process in a light gauge steel design can require extensive temporary blocking and bracing to ensure workers' safety and to keep items properly located until the sheathing is applied. To overcome this, many light gauge steel truss designs are partially assembled within a factory and shipped to a job site or assembled on the ground at a job site and hoisted by crane to their final position. Both of these options add to complexity and the expense of the final roof framing design.

In the present invention, the truss panel contains structural members molded within an expanded polymer matrix body that fixes the position of and insulates the light gauge steel members. The expanded polymer matrix core body contributes to the structural integrity of the assembly during transport to the site and during the erection process.

The present adjustable composite roof truss can be of any length and orientation and can be molded using a continuous or semi-continuous process. The exposed portion of the structural members extending from the polymer matrix and running the length of the panel are used to fix top cords (or roof truss members), bottom cords (or roof base members), king posts and webs of a truss depending on the requirements of the desired spans and load designs. The orientation of the insulating polymer matrix body can be reversed adding to the adaptability of the panel to meet building design requirements. The cords and webs attached to the molded panel can be configured to create various truss configurations and roof slopes.

Thus, the roof truss members and roof base members are able to pivot from a parallel orientation to an orientation where the roof truss members form and angle relative to the base members.

The top cords (roof truss members) and bottom cords (roof base members) are attached in a fashion that allows the assembled truss to be transported to the construction site in a fully collapsed position. As in some embodiments of the invention, upon placement of two opposing truss sections in their final position, the top cords use a scissoring motion to move into the correct roof slope arrangement and are affixed by use, as a non-limiting example, of fasteners and connection plates top and bottom to the corresponding opposing truss section. The steel framing members, top cords, bottom cords, king post and webs can include openings to allow the use of a self locking blocking bar, which effectively eliminates the need for sixty to seventy percent of the fasteners required in normally manufactured steel truss designs.

As used herein, the term "expandable polymer matrix" refers to a polymeric material in particulate or bead form that can be impregnated with a blowing agent such that when the particulates and/or beads are placed in a mold and heat is applied thereto, evaporation of the blowing agent (as described below) effects the formation of a cellular structure and/or an expanding cellular structure in the particulates and/or beads and the outer surfaces of the particulates and/or beads fuse together to form a continuous mass of polymeric material conforming to the shape of the mold.

The expanded polymer matrix makes up the expanded polymer body, panels and/or forms described herein below. The expanded polymer matrix is typically molded from expandable thermoplastic particles. These expandable thermoplastic particles are made from any suitable thermoplastic homopolymer or copolymer. Particularly suitable for use are homopolymers derived from vinyl aromatic monomers including styrene, isopropylstyrene, alpha-methylstyrene, nuclear methylstyrenes, chlorostyrene, tert-butylstyrene, and the like, as well as copolymers prepared by the copolymerization of at least one vinyl aromatic monomer as described above with one or more other monomers, non-limiting examples being divinylbenzene, conjugated dienes (non-limiting examples being butadiene, isoprene, 1,3- and 2,4-hexadiene), alkyl methacrylates, alkyl acrylates, acrylonitrile, and maleic anhydride, wherein the vinyl aromatic monomer is present in at least 50% by weight of the copolymer. In an embodiment of the invention, styrenic polymers are used, particularly polystyrene. However, other suitable polymers can be used, such as polyolefins (e.g., polyethylene, polypropylene), polycarbonates, polyphenylene oxides, and mixtures thereof.

As used herein, the terms "(meth)acrylic" and "(meth) acrylate" are meant to include both acrylic and methacrylic acid derivatives, such as the corresponding alkyl esters often referred to as acrylates and (meth)acrylates, which the term "(meth)acrylate" is meant to encompass.

In various embodiments of the invention, the expandable thermoplastic particles are expandable polystyrene (EPS) particles. These particles can be in the form of beads, granules, or other particles convenient for the expansion and molding operations. Particles polymerized in an aqueous suspension process are essentially spherical and are useful for molding the expanded polymer body, panels and/or forms described herein below. These particles can be screened so that their size ranges from about 0.008 to about 0.15 inch (0.20 mm to about 3.81 mm) prior to expansion.

The expandable thermoplastic particles can be impregnated using any conventional method with a suitable blowing agent. As a non-limiting example, the impregnation can be achieved by adding the blowing agent to the aqueous suspension during the polymerization of the polymer, or alternatively by re-suspending the polymer particles in an aqueous medium and then incorporating the blowing agent as taught in U.S. Pat. No. 2,983,692. Any gaseous material or material which will produce gases on heating can be used as the blowing agent. Conventional blowing agents include aliphatic hydrocarbons containing 4 to 6 carbon atoms in the molecule, such as butanes, pentanes, hexanes, and the halogenated hydrocarbons, e.g., CFC's and HCFC's, which boil at a temperature below the softening point of the polymer chosen. Mixtures of these aliphatic hydrocarbon blowing agents can also be used.

Alternatively, water can be blended with these aliphatic hydrocarbons blowing agents or water can be used as the sole blowing agent as taught in U.S. Pat. Nos. 6,127,439; 6,160,027; and 6,242,540. In these patents, water-retaining agents are used. The weight percentage of water for use as the blowing agent can range from 1 to 20%. The texts of U.S. Pat. Nos. 6,127,439, 6,160,027 and 6,242,540 are incorporated herein by reference.

The impregnated thermoplastic particles are generally pre-expanded to a density of at least 0.1 lb/ft$^3$, in some cases at least 0.25 lb/ft$^3$, in other cases at least 0.5 lb/ft$^3$, in some situations at least 0.75 lb/ft$^3$, in other situations at least 1 lb/ft$^3$, and in some instances at least about 2 lb/ft$^3$. Also, the density of the impregnated pre-expanded particles can be up to 12 lb/ft$^3$, in some cases up to 10 lb/ft$^3$, and in other cases up to 5 lb/ft$^3$. The density of the impregnated pre-expanded particles can be any value or range between any of the values recited above. The pre-expansion step is conventionally carried out by heating the impregnated beads via any conventional heating medium, such as steam, hot air, hot water, or radiant heat. One generally accepted method for accomplishing the pre-expansion of impregnated thermoplastic particles is taught in U.S. Pat. No. 3,023,175.

The impregnated thermoplastic particles can be foamed cellular polymer particles as taught in U.S. Patent Publication No. 2002/0117769, the teachings of which are incorporated herein by reference. The foamed cellular particles can be polystyrene that are pre-expanded and contain a volatile blowing agent at a level of less than 6.0 weight percent, in some cases ranging from about 2.0 wt % to about 5.0 wt %, and in other cases ranging from about 2.5 wt % to about 3.5 wt % based on the weight of the polymer.

An interpolymer of a polyolefin and in situ polymerized vinyl aromatic monomers that can be included in the expandable thermoplastic resin according to various embodiments of the present invention is disclosed in U.S. Pat. Nos. 4,303,756, 4,303,757 and 6,908,949, the relevant portions of which are herein incorporated by reference. Non-limiting examples of interpolymers that can be used in the present invention include those available under the trade name ARCEL®, available from NOVA Chemicals Inc., Pittsburgh, Pa. and PIOCELAN®, available from Sekisui Plastics Co., Ltd., Tokyo, Japan.

The expanded polymer matrix can include customary ingredients and additives, such as pigments, dyes, colorants, plasticizers, mold release agents, stabilizers, ultraviolet light absorbers, mold prevention agents, antioxidants, and so on. Typical pigments include, without limitation, inorganic pigments such as carbon black, graphite, expandable graphite, zinc oxide, titanium dioxide, and iron oxide, as well as organic pigments such as quinacridone reds and violets and copper phthalocyanine blues and greens.

In one embodiment of the invention, the pigment is carbon black, a non-limiting example of such a material is EPS SILVER® pigment, available from NOVA Chemicals Inc.

In another embodiment of the invention the pigment is graphite, a non-limiting example of such a material is NEOPOR® pigment, available from BASF Aktiengesellschaft Corp., Ludwigshafen am Rhein, Germany.

When materials such as carbon black and/or graphite are included in the polymer particles, improved insulating properties, as exemplified by higher R values for materials containing carbon black or graphite (as determined using ASTM-C578), are provided. As such, the R value of the expanded polymer particles containing carbon black and/or graphite or materials made from such polymer particles are at least 5% higher than observed for particles or resulting articles that do not contain carbon black and/or graphite.

The pre-expanded particles or "pre-puff" are heated in a closed mold in the semi-continuous or continuous molding process described below to form the pre-formed building panels according to various embodiments of the present invention.

In some embodiments, portions of the central body of the roof truss panel can further include materials in addition to the expanded polymer matrix, as non-limiting examples ultraviolet (UV) stabilizers, heat stabilizers, flame retardants, structural enhancements, biocides, and combinations thereof.

As shown in FIGS. 1-5, the adjustable composite roof truss system 10 includes a body 44 of an expanded polymer matrix, that can be molded in a continuous or semi continuous process, and allows for the partial or full encapsulation of a structural framing member (roof base member 24 as shown) with a structure that is limited in length only by methods of transportation.

The truss panel 50, into which one or more light gauge steel structural members (roof base member 24 as shown) include a series of expansion holes 64 as will be described below, which allow the polymer matrix to expand through. The result is an expanded polymer matrix that fuses through expansion holes 64 and creating thermal break pathways in the steel members. The structural members typically extend out of the main polymer matrix body 44 at predetermined heights thus allowing for the fixing of additional framing members that will complete the load carrying capacity and architectural detail of a roof design.

The expanded polymer matrix body 44 of panel 50 fixes in place roof base members 24 of adjustable composite roof truss system 10 at predetermined locations facilitating the exact placement of roof base members 24 in relationship to the load carrying structure of roof truss system 10. The expanded polymer matrix body 44, when in position, provides insulation that does not require further installation steps to create an effective thermal barrier. Roof truss members 12 are attached to a portion of roof base member 24 extending from the expanded polymer matrix body 44 at predetermined locations to complete the truss design. The attachment points can be designed as to allow for different configurations of the truss design, thus allowing for various eave overhangs, roof slopes and roof designs. These attachment points facilitate the creation of common architectural designs such as hip, gable, shed and flat roof configurations.

The attached members can be configured to be collapsible which results in economical transportation of the completed assembly to a job site. Upon arrival and placement of the truss panel into final position, the roof truss members 12 move in a scissor-like motion into the correct position to mate with an opposing roof truss member 12 (see FIGS. 1 and 5) and is fixed to the slope required using a roof truss connector (54 in FIG. 1 and 56 in FIG. 5). The roof base member 24 is contained within the expanded polymer matrix body for proper positioning and ease of installation.

The aligned support openings 61 and 58 within the exposed portion of roof base member 24 and the scissoring portion of roof truss member 12 respectively can be used to affix a blocking and screw strip modified connecting bar (not shown, but described below) into position. The connecting bar creates a permanent lateral blocking and bracing member, which contributes to load carry capacity of the final roof design.

Support openings 58 and 61 are generally elongated or oval openings that have a length and a width. The width of support openings 58 and 61 can be about 1 inch (2.5 cm) to about 3 inches (7.6 cm) in some cases about 1.75 inches (4.4 cm) to about 2.5 inches (6.4 cm) and in other cases about 2.25 inches (5.7 cm). Support openings 58 and 61 can have a length of about 4 inches (10.2 cm) to about 5.5 inches (14 cm), for example 4.75 inches (12.1 cm).

As shown in the embodiments depicted in FIGS. 1-5, adjustable composite roof truss 10 includes one or more roof truss members 12 and one or more roof base members 24. The one or more roof truss members 12 include a pivot end 14, a connection end 16, a roof facing edge 18, an inside surface 20, and a pivot surface 22. The one or more roof base members 24 include a receiving end 26, an optional connecting end 28, a top edge 30, a bottom edge 32, and a contact surface-34. Roof truss members 12 are pivotally connected to roof base members 24 using a pivot fastener 36 inserted through a pivot opening 38 positioned along contact surface 34 of roof base members 24 and a stator opening (not shown here but shown as 190 in FIGS. 12-16) along roof truss members 12. One or more of roof truss members 12 and roof base members 24 include an embedded portion 42 extending from roof facing edge 18 or bottom edge 32 respectively, creating a "CC" type member such that embedded portion 42 longitudinally extends across and into central body 44. Body 44 can be substantially parallelepipedic in shape and contains an expanded polymer matrix, having opposite faces, a first surface 60 and an opposing second surface 62. One or more expansion holes 64 are positioned along embedded portion 42 between first surface 60 and second surface 62 of central body 44 such that the polymer matrix expands through expansion holes 64.

Embodiments of the invention provide an adjustable composite roof truss system 10, as shown in FIG. 1, having one roof base member 24 with pivot openings 38 near each end and two roof truss members 12 pivotally attached using a pivot fastener 36 inserted through a stator opening (not shown) as described above. Ridge brace 17 can optionally be included and attached to connection ends 16 of roof truss members 12 to strengthen the resulting roof truss structure.

Figure 5:
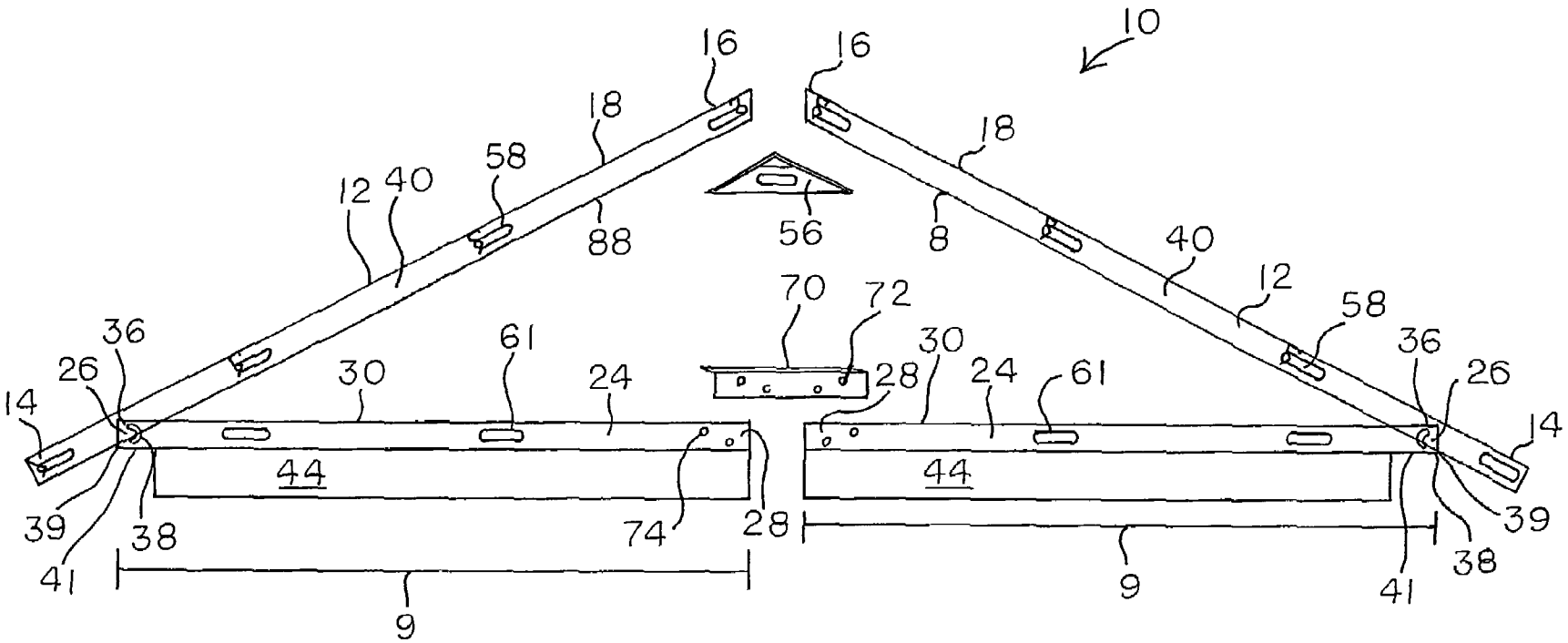
FIG. 5 is a front elevation view of a roof truss system according to the invention.

Other embodiments of the invention provide an adjustable composite roof truss system 10, as shown in FIG. 5, where one roof base member 24 with pivot openings 38 near receiving end 26 and one roof truss member 12 are pivotally attached using a pivot fastener 36 inserted through a stator opening (not shown) as described above. In this embodiment, opposing connecting ends 28 of two roof base members are attached by way of center connection plate 70. Fastening holes 72 in connection plate 70 are aligned with attachment holes 74 in roof base members 24 and fasteners (not shown) are inserted through corresponding fastening holes 72 and attachment holes 74 to attach roof base members 24.

In many embodiments of the invention, roof truss system 10 is placed on wall 52, which optionally can be connected. In particular embodiments of the invention, a pivot opening end 39 portion of the embedded portion of roof base member 24 and central body 44 of roof base member 24 is removed to provide a support receiving space 41 at pivot opening end 39 of roof base member 24. Optionally, a mating cap 43 can be placed along the top surface of wall 52 to facilitate attachment of roof truss system 10 to wall 52. In this way, support receiving space 41 can receive the top surface of the wall 52.

Figure 6:
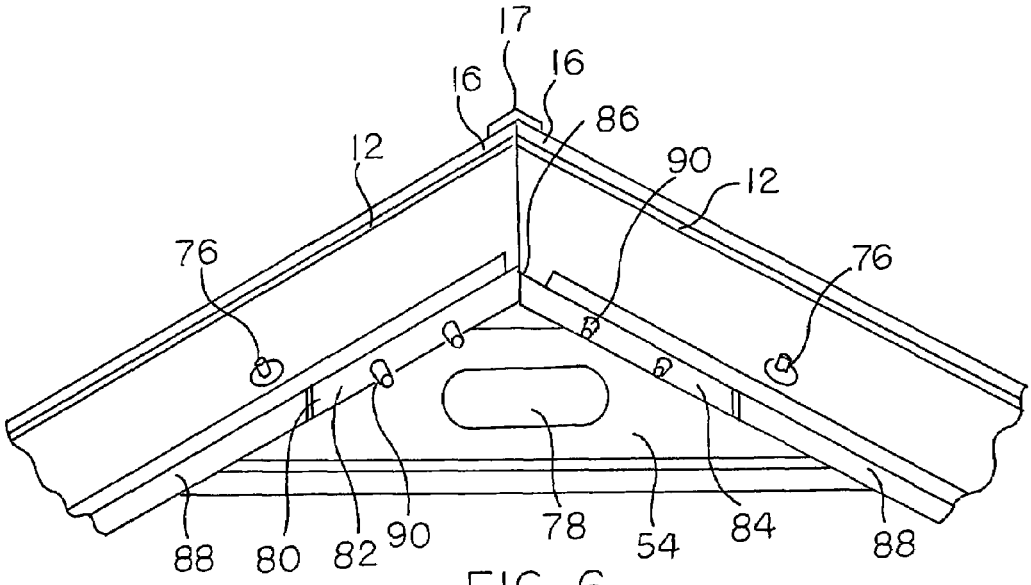
FIG. 6 is a partial perspective view of a roof truss system according to the invention.

Opposing connection ends 16 of roof truss members 12 can be attached by way of roof truss connectors 54 (FIG. 1) or 56 (FIG. 5). As shown in FIG. 6, roof truss connector 54 can be attached to connection ends 16 of roof truss members 12 by inserting fasteners 76 through aligned openings in roof truss members 12 and roof truss connector 54. Connection ends 16 can be have mitered angles to provide a flush interface between connection ends 16. Additionally, angle iron 80, which includes first leg 82 and second leg 84 which form an angle at bend 86 corresponding to the angle formed between roof truss members 12, can be attached to bottom edge 88 of roof truss members 12 by inserting fasteners 90 through aligned openings in roof truss members 12 and angle iron 80. Also, ridge support opening 78 in roof truss connector 54 can be aligned with other ridge support openings 78, which can be used to affix a blocking and screw strip modified connecting bars (not shown, but described below) into position. The connecting bar creates a permanent lateral blocking and bracing member, which contributes to load carry capacity of the final roof design. Ridge brace 17 can optionally be included and attached to connection ends 16 of roof truss members 12 to strengthen the resulting roof truss structure.

Figure 7:
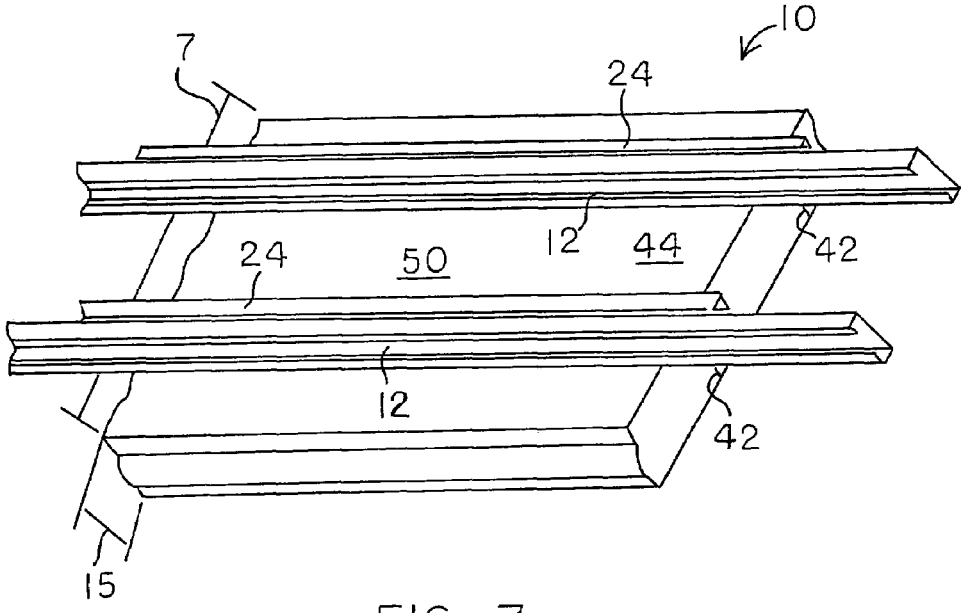
FIG. 7 is a partial perspective view of a roof truss system according to the invention.

FIG. 7 shows adjustable composite roof truss 10 in a closed position. As shown, truss panel 50 includes body 44, into which embedded portion 42 of roof base member 24 is embedded, and roof truss members 12. In the closed position, roof truss member 12 and roof base member 24 are oriented approximately parallel to each other. This is the configuration in which adjustable composite roof truss 10 would be shipped to a construction site.

FIGS. 8-11 show embodiments of the invention where roof truss members 12 (in the form of "CC" members as shown in FIGS. 12-16) are embedded into body 44 to form roof panels 90. In this embodiment, embedded portion 42 extends from roof facing edge 18 such that embedded portion 42 longitudinally extends across and into central body 44, which can be substantially parallelepipedic in shape and contains an expanded polymer matrix. One or more expansion holes 64 (as shown in FIGS. 3 and 12-16) are positioned along embedded portion 42 such that the polymer matrix expands through expansion holes 64. Roof truss members 12 and roof base members can be attached as described above.

Figure 8:
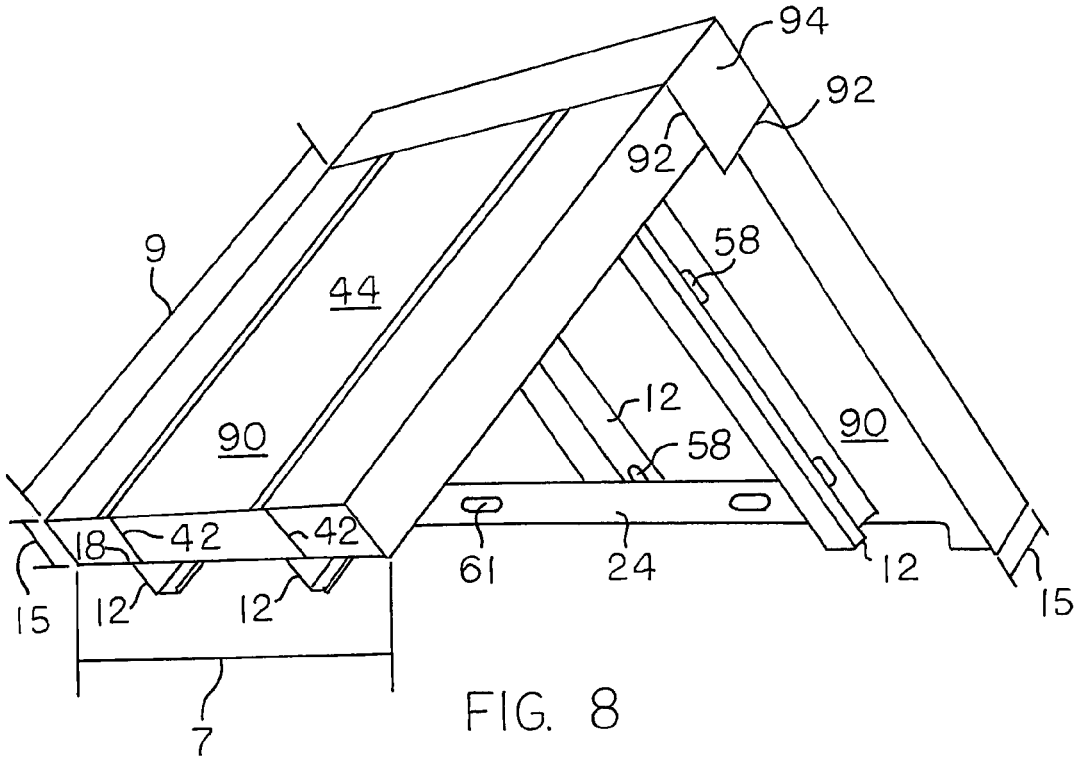
FIG. 8 is a perspective view of a roof truss system according to the invention.

In an embodiment of the invention shown in FIG. 8, body 44 can be have ridge ends 92 that are generally perpendicular to roof truss members 12. In this embodiment, ridge insulation member 94, which is cut to match the opening formed by ridge ends 92 and the desired roof design is attached to ridge ends 92 by way of a suitable adhesive.

Figure 9:
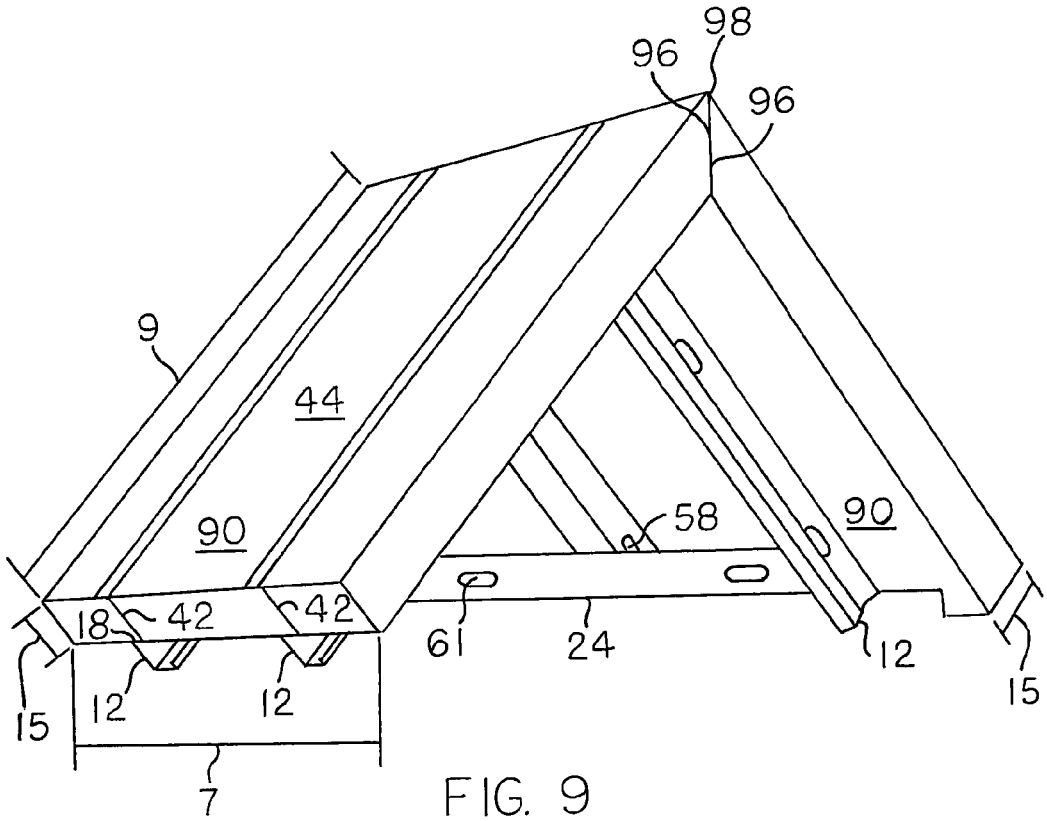
FIG. 9 is a perspective view of a roof truss system according to the invention.
Figure 10:
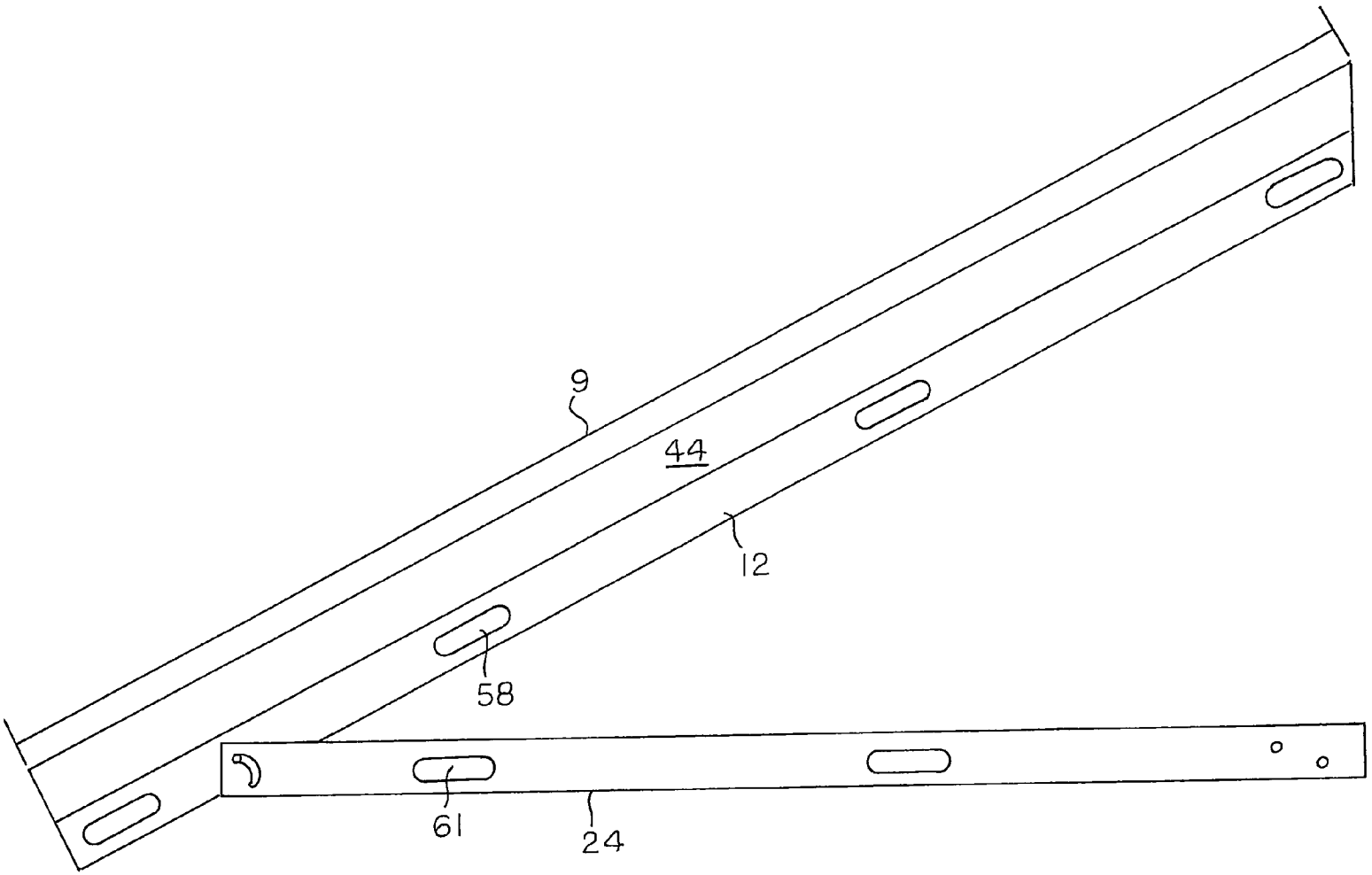
FIG. 10 is a front elevation view of a roof truss system according to the invention.

In another embodiment of the invention shown in FIG. 9, body 44 can be have ridge ends 96 that have a mitered cut where opposing ridge ends 96 interface to form a ridge peak 98. Ridge ends 96 can be attached by way of a suitable adhesive.

Figure 11:
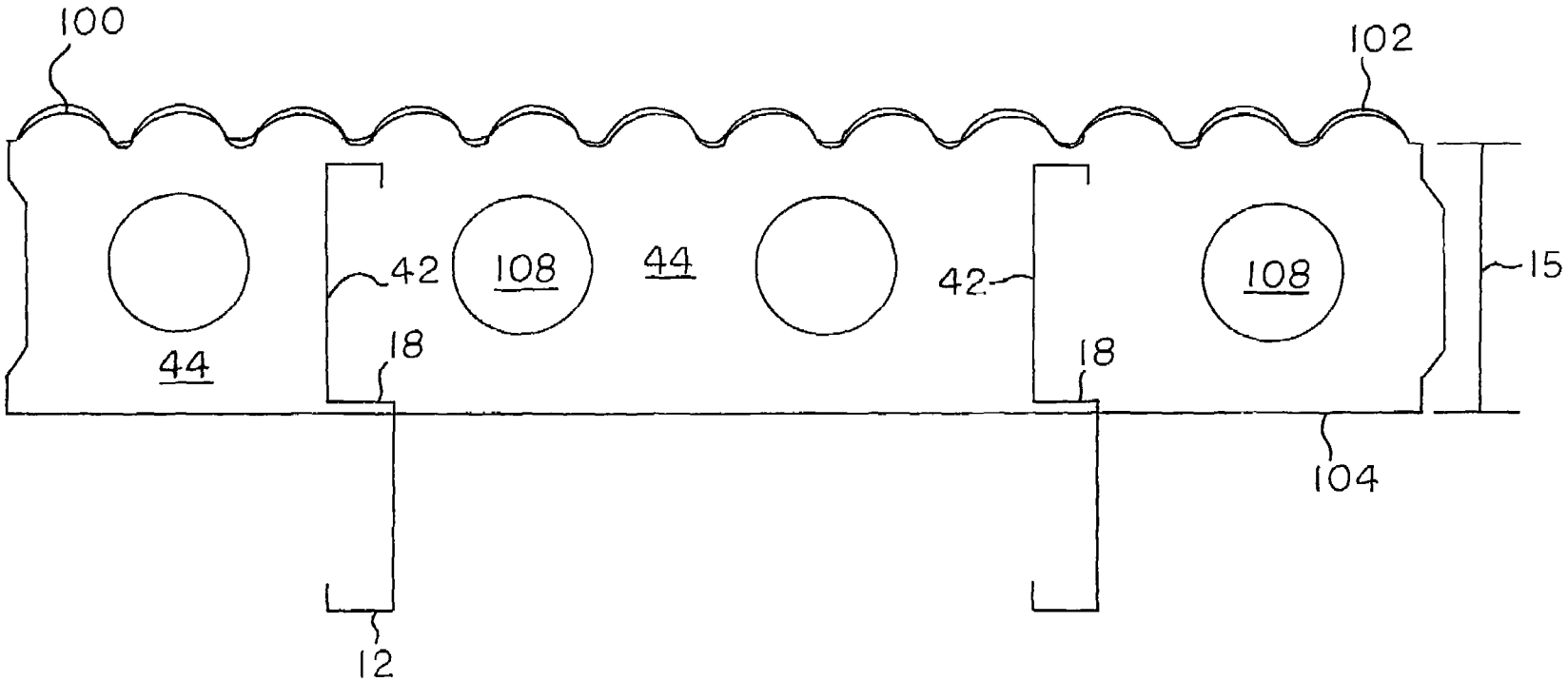
FIG. 11 is front elevation view of a roof truss panel used in the invention.

In a further embodiment of the invention shown in FIG. 11, top surface 100 of body 44 can have a corrugated shape that can include a metal top layer 102. In embodiments of the invention, an asphalt fiber material or other suitable coating can be applied to top surface 100.

Also, top edge 30 of roof base member 24 or bottom edge 88 of roof truss member 12 can extend away from a surface 104 of expanded polymer body 44.

Referring now to FIGS. 2, 5 and 7-9, expanded polymer body 44 has a length 9. The expanded polymer body 44 can be manufactured in a variety of different sizes that would facilitate its safe handling and minimal damage during shipping and installation thereof. The length 9 of expanded polymer body 44 can be at least about 3.3 feet (1 m), in some cases at least about 4.9 feet (1.5 m), and in other cases at least about 6.6 feet (2 m) and can be up to about 82 feet (25 m), in some cases up to about 65.6 feet (20 m), in other cases up to about 49.2 feet (15 m), in some instances up to about 32.8 feet (10 m) and in other instances up to about 16.4 feet (5 m). In various embodiments, the length 9 of expanded polymer body 44 can generally be determined by the length of embedded members 12 or 24. The length 9 of expanded polymer body 44 can be any value or can range between any of the values recited above.

The width 7 of expanded polymer body 44 can be any height that allows for the safe handling and minimal damage to expanded polymer body 44 during shipping and installation. In various embodiments, the width 7 can generally be determined by the size of the molding equipment. In various embodiments, the width 7 of expanded polymer body 44 can be at least about 3.3 feet (1 m) and in some cases at least about 4.9 feet (1.5 m) and can be up to about 9.8 feet (3 m) and in some cases up to about 8.2 feet (2.5 m). The width 7 of expanded polymer body 44 can be any value or can range between any of the values recited above.

Expanded polymer body 44 can have a thickness 15 of at least about 0.8 inches (2 cm), in some cases at least about one inch (2.5 cm), and in other cases at least about 1.2 inches (3 cm) and can be up to about 12 inches (30.5 cm), in some cases up to about 8 inches (23.3 cm), and in other cases up to about 6 inches (15.2 cm). One skilled in the art will appreciate that the polymer body 44 could be provided in other thicknesses without departing from the spirit and scope of the present invention. The thickness 15 of expanded polymer body 44 can be any value or can range between any of the values recited above.

Referring to FIG. 11, in some embodiments, expanded polymer body 44 can include one or more openings 108 that traverse all or part of the length and/or width of expanded polymer body 44, for example holes, conduits or chases can be molded into and extend along the length of the expanded polymer body 44. It is conceivable, however, that the expanded polymer body 44 may also be provided without any such openings therethrough. In some embodiments of the present invention, the holes, conduits or chases may be used as access ways for accommodating utilities, such as wiring, plumbing and exhaust vents within the walls, ceilings, floors and roofs constructed according to various embodiments of the present invention.

Openings 108 can have various cross-sectional shapes, non-limiting examples being round, oval, elliptical, square, rectangular, triangular, hexagonal or octagonal. The cross-sectional size or area of openings 108 can be uniform or they can vary independently of each other with regard to size and location. The spacing between each opening 108 can be at least about 2 inches (5 cm) and in some cases at least about 3.9 inches (10 cm) and can be up to about 3.6 feet (110 cm), in some cases up to about 3.3 ft (100 cm), in other cases up to about 2.5 ft (75 cm), and in some instances up to about 2 ft (60 cm) measured from a midpoint of one opening 108 to a midpoint of an adjacent opening 108. The spacing between openings 108 can independently be any distance or range between any of the distances recited above.

The cross-sectional area of openings 108 can also vary independently one from another or they can be uniform. The cross-sectional area of openings 108 is limited by the dimensions of expanded polymer body 44, as openings 108 will fit within the dimensions of expanded polymer body 44. The cross-sectional area of openings 108 can independently be at least about 0.16 $in^2$ (1 $cm^2$), in some cases at least about 0.8 $in^2$ (5 $cm^2$), and in other cases at least about 1.4 $in^2$ (9 $cm^2$) and can be up to about 20.2 $in^2$ (130 $cm^2$), in some cases up to about 15.5 $in^2$ (100 cm), and in other cases up to about 11.6 $in^2$ (75 $cm^2$). The cross-sectional area of openings 108 can independently be any value or range between any of the values recited above.

In the various embodiments of the present invention, roof truss members 12 or roof base members 24 (whichever is embedded in expanded polymer matrix 44) provides strength and rigidity to roof truss panel 50 and to expanded polymer matrix containing body 44 to generally enhance the panel's structural integrity to thereby enable the panel to withstand the anticipated loads and stresses that it will likely encounter when installed. The reinforcing members employed in various embodiments of the present invention can include a variety of different structural members, bars, joists, studs and other structural profiles without departing from the spirit and scope of the present invention. In many embodiments, truss members 12 or roof base members 24 are used as reinforcing members in the form of conventional metal studs. Roof truss members 12 or roof base members 24 are spaced from each other across the width 7 of body 44 and extend longitudinally therein. In some embodiments, roof truss members 12 or roof base members 24 are arranged as a left facing embedded metal member and a right facing embedded metal member. One skilled in the art would understand that in alternative embodiments, a single reinforcing member or more than two reinforcing members can be used as desired.

Roof truss members 12 or roof base members 24 used in various embodiments of the invention can be made of any suitable material. Suitable materials are those that add strength, stability and structural integrity to the pre-formed roof panels. Such materials can provide embedded members meeting the requirements of applicable test methods known in the art, as non-limiting examples ASTM A 36/A 36M-05, ASTM A 1011/A 1011M-05a, ASTM A 1008/A 1008M-05b, and ASTM A 1003/A 1003M-05 for various types of steel.

Suitable materials include, but are not limited to metals, construction grade plastics, composite materials, ceramics, combinations thereof, and the like. Suitable metals include, but are not limited to, aluminum, steel, stainless steel, tungsten, molybdenum, iron and alloys and combinations of such metals. In various particular embodiments of the invention, the reinforcing members are made of a light gauge metal.

Suitable construction grade plastics include, but are not limited to reinforced thermoplastics, thermoset resins, and reinforced thermoset resins. Thermo-plastics include polymers and polymer foams made up of materials that can be repeatedly softened by heating and hardened again on cooling. Suitable thermoplastic polymers include, but are not limited to homopolymers and copolymers of styrene, homopolymers and copolymers of $C_2$ to $C_{20}$ olefins, $C_4$ to $C_{20}$ dienes, polyesters, polyamides, homopolymers and copolymers of $C_2$ to $C_{20}$ (meth)acrylate esters, polyetherimides, polycarbonates, polyphenylethers, polyvinylchlorides, polyurethanes, and combinations thereof.

Suitable thermoset resins are resins that when heated to their cure point, undergo a chemical cross-linking reaction causing them to solidify and hold their shape rigidly, even at elevated temperatures. Suitable thermoset resins include, but are not limited to alkyd resins, epoxy resins, diallyl phthalate resins, melamine resins, phenolic resins, polyester resins, urethane resins, and urea, which can be crosslinked by reaction, as non-limiting examples, with diols, triols, polyols, and/or formaldehyde.

Reinforcing materials that can be incorporated into the thermoplastics and/or thermoset resins include, but are not limited to carbon fibers, aramid fibers, glass fibers, metal fibers, fiberglass, carbon black, graphite, clays, calcium carbonate, titanium dioxide, woven fabric or structures of the above-referenced fibers, and combinations thereof.

A non-limiting example of construction grade plastics are thermosetting polyester or vinyl ester resin systems reinforced with fiberglass that meet the requirements of required test methods known in the art, non-limiting examples being ASTM D790, ASTM D695, ASTM D3039 and ASTM D638.

The thermoplastics and thermoset resins can optionally include other additives, as a non-limiting example ultraviolet (UV) stabilizers, heat stabilizers, flame retardants, structural enhancements, biocides, and combinations thereof.

In an embodiment of the invention, one or more surfaces of the embedded portion of the reinforcing members used herein can have a texturized surface. As used herein, "texturized surface" refers to a non-smooth surface that includes surface alterations, non-limiting examples of such include dimples and corrugation. Methods for texturizing such surfaces are disclosed, for example in U.S. Pat. Nos. 6,183,879 and 5,689,990, the disclosures of which are herein incorporated by reference in their entirety. Texturized surfaces can provide improved strength in the reinforcing members and/or improved adherence between the reinforcing members and the expanded polymer matrix.

Roof truss members 12 or roof base members 24 can have a variety of different thicknesses depending upon the intended use and desired physical properties of the panel. For example, in various embodiments, the reinforcing members may have a thickness of at least 0.016 inches (0.4 mm) to up to 0.394 inches (10 mm), in some instances at least 0.039 inches (1 mm) and in other instances at least up to 0.314 inches (8 mm).

In some embodiments of the invention, the embedded portions 42 do not extend all the way through the expanded polymer body 44 to touch the outer surface of expanded polymer body 44. Embedded portions 42 can extend any distance into the expanded polymer body 44.

In some embodiments, the embedded portions 42 extend all the way through the expanded polymer body 44 to be flush with an outer surface of expanded polymer body 44 or emerge through the outer surface to provide an exposed portion.

Embedded portions 42 can extend at least about 0.4 inches (1 cm), in some cases at least about 0.8 inches (2 cm), and in other cases at least about 1.2 inches (3 cm) into expanded polymer body 44. Also, embedded portions 42 can extend up to about 3.9 inches (10 cm), in some cases up to about 3.2 inches (8 cm), and in other cases up to about 2.4 inches (6 cm) into expanded polymer body 44. One skilled in the art will appreciate that the embedded portions 42 can be located within the expanded polymer body 44 at a variety of different distances or can range between any of the distances recited above into polymer body 44.

For example, in still other embodiments of the present invention, embedded portions 42 can be embedded within the polymer body 44 at distances of about from 1/10 to 9/10 , in some cases 1/3 to 2/3 and in other cases 1/4 to 3/4 of the thickness of expanded polymer body 44. However, in other embodiments, side portions 42 can be completely exposed to facilitate attachment of finish surfaces or members thereto.

As indicated above, one or more expansion holes 64 are positioned along embedded portion 42 such that the polymer matrix expands through expansion holes 64 of roof truss members 12 or roof base members 24. The expansion holes can be arrayed in any suitable design so long as the strength of the member remains adequate. In many embodiments, the expansion holes are arrayed to minimize thermal transfer through the member.

Figure 3:
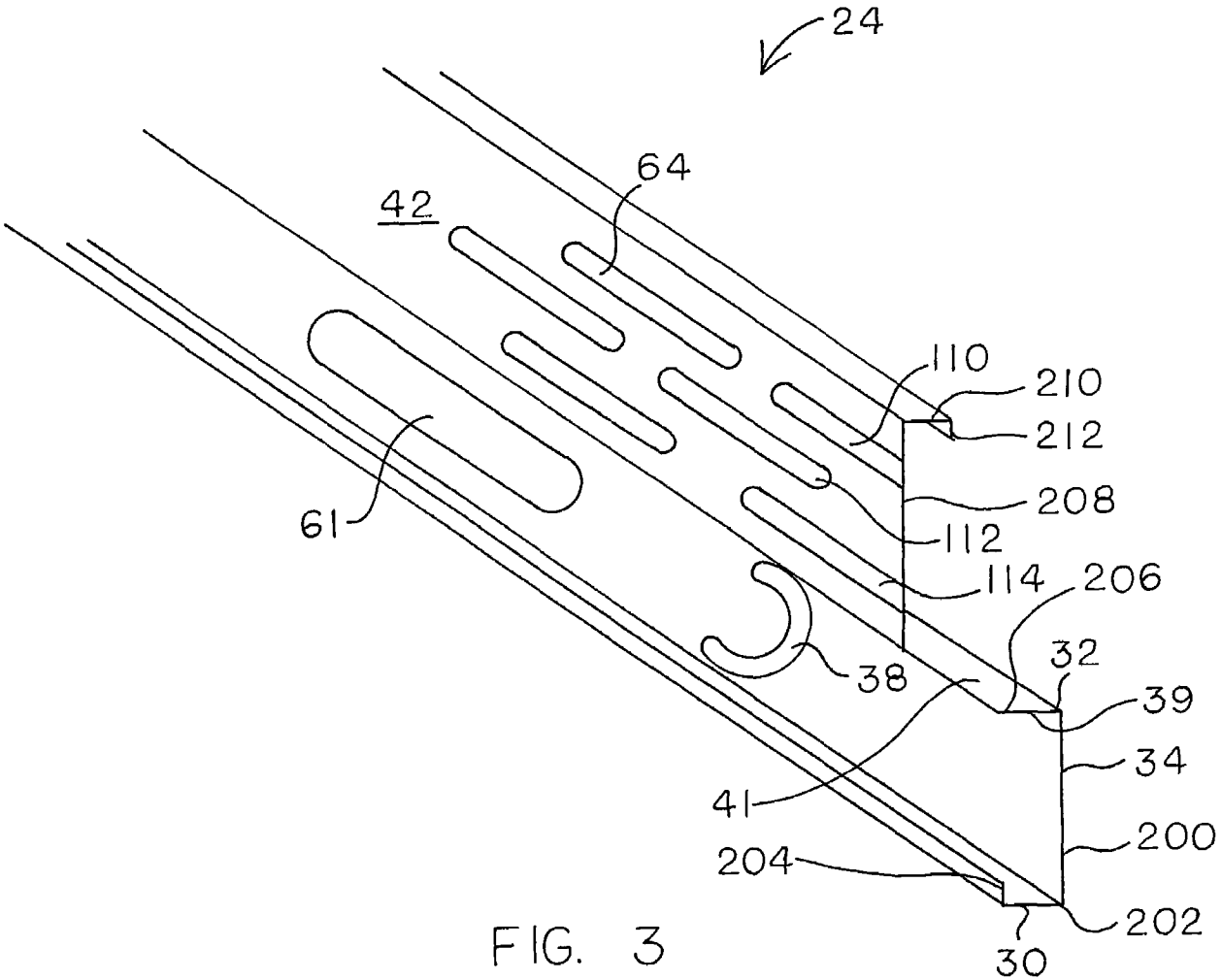
FIG. 3 is a partial perspective view of a roof base member used in the invention.
Figure 4:
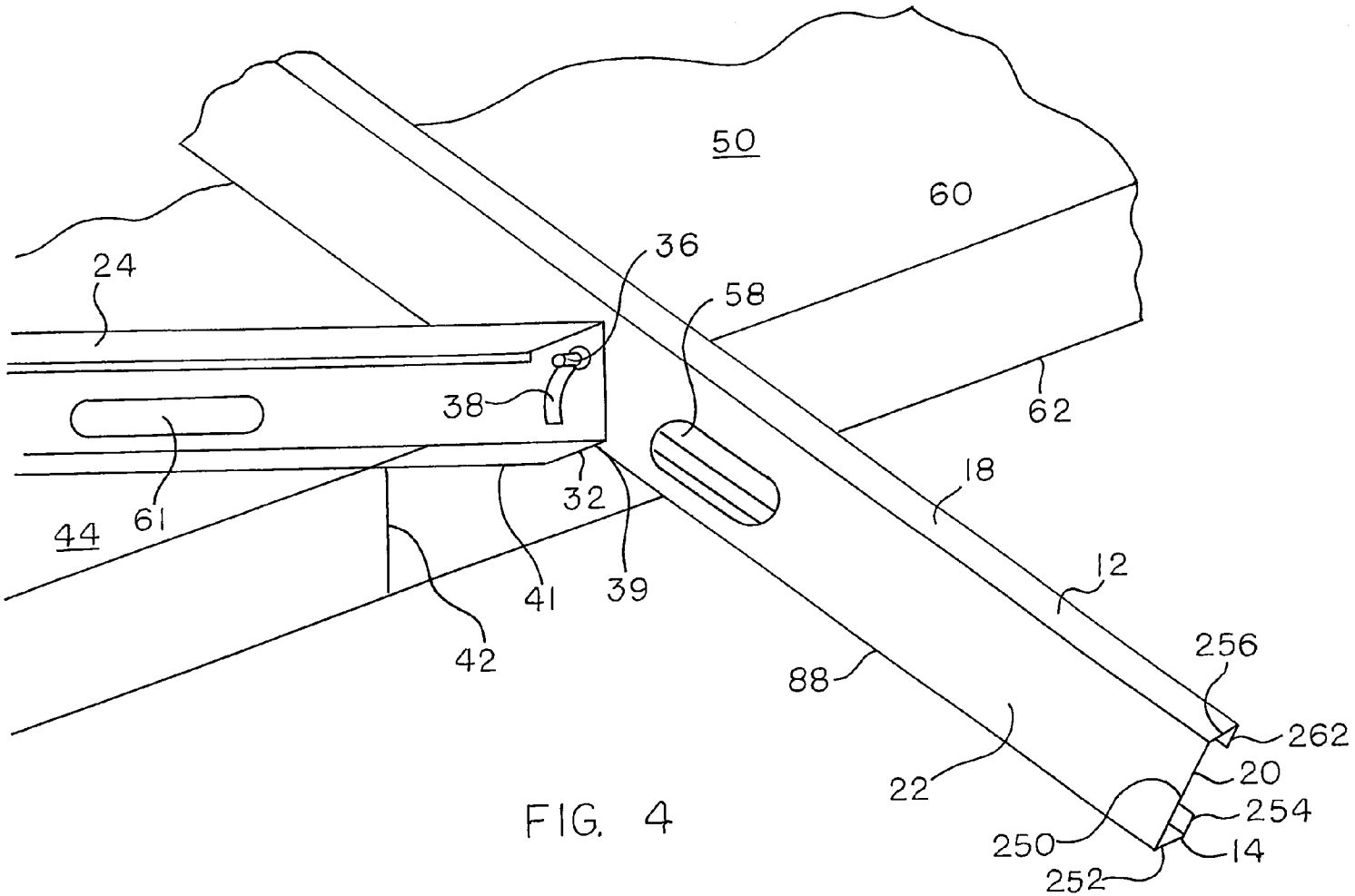
FIG. 4 is a partial perspective view of a roof truss system according to the invention.

In an embodiment shown in FIG. 3, embedded portion 42 (as shown with base member 24) includes a first row 110 of equally spaced, elongated or oval expansion holes 64, a second row 112 of equally spaced, elongated or oval expansion holes 64, and a third row 114 of equally spaced, elongated or oval expansion holes 64 extending along a length of embedded portion 42. Second row 112 can be offset with respect to first and third rows 110 and 114 respectively. Each expansion hole 64 of each row 110, 112 and 114 of elongated or oval expansion holes 64 can have a length of about 4.3 inches (11 cm) to about 5.5 inches (14 cm), for example 5 inches (12.7 cm), and a width of about 0.1 inches (0.25 cm) to about 0.4 inches (1 cm), for example 0.25 inches (0.64 cm). However, the sizes, shapes, numbers and spacing arrangement of expansion holes 64 can vary without departing from the spirit and scope of the present invention.

Figure 12:
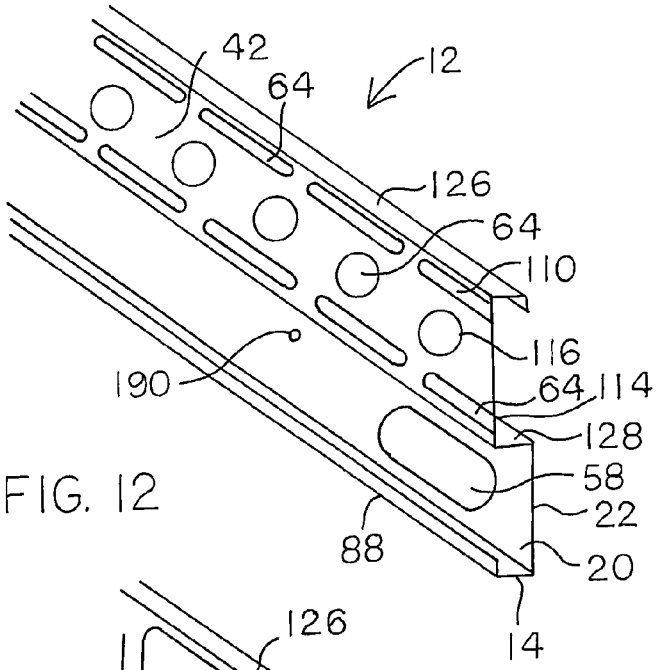
FIG. 12 is a partial perspective view of a roof truss member used in the invention.

In an embodiment shown in FIG. 12, embedded portion 42 (as shown with roof truss member 12) includes a first row 110 of equally spaced, elongated or oval expansion holes 64, a second row 116 of equally spaced, elongated or circular expansion holes 64, and a third row 114 of equally spaced, elongated or oval expansion holes 64 extending along a length of embedded portion 42. Second row 116 can be offset with respect to first and third rows 110 and 114 respectively. Each expansion hole 64 of each row 110 and 114 of elongated or oval expansion holes 64 can have a length of about 4.3 inches (11 cm) to about 5.5 inches (14 cm), for example 5 inches (12.7 cm), and a width of about 0.1 inches (0.25 cm) to about 0.4 inches (1 cm), for example 0.25 inches (0.64 cm). Each expansion hole 64 of row 112 of circular expansion holes 64 can have a radius of about 0.1 inches (0.25 cm) to about 1 inch (2.5 cm), for example 0.75 inches (1.9 cm). However, the sizes, shapes, numbers and spacing arrangement of expansion holes 64 can vary without departing from the spirit and scope of the present invention.

Figure 13:
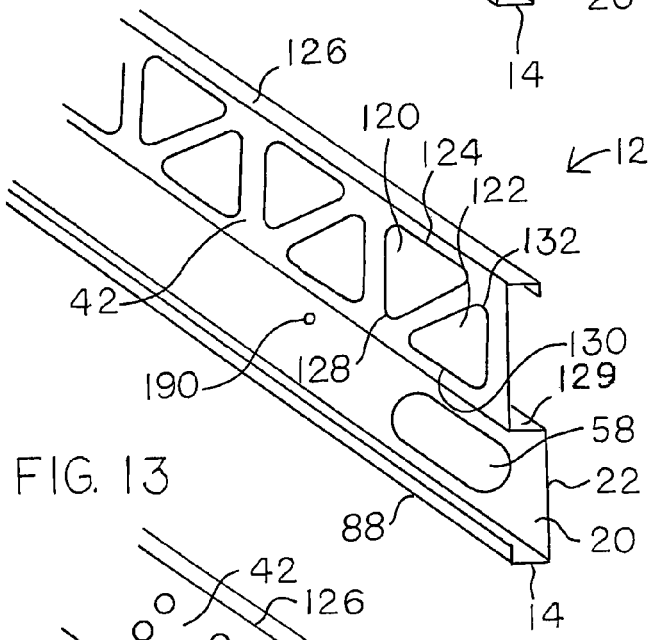
FIG. 13 is a partial perspective view of a roof truss member used in the invention.

In an embodiment shown in FIG. 13, embedded portion 42 (as shown with roof truss member 12) can include a row of generally alternating first generally triangular expansion holes 120 and second generally triangular holes 122 extending along a length of embedded portion 42. First triangular holes 120 can include a base 124 positioned generally parallel to flange 126 and an apex 128 oriented toward intersecting edge 129. Second triangular holes 122 can include a base 130 positioned generally parallel to intersecting edge 129 and an apex 132 oriented toward flange 126. First triangular holes 120 and second triangular holes 122 can generally make up equilateral triangles with each edge of each triangular hole 120 and 122 having a length of about 1.6 inches (4 cm) to about 2.4 inches (6 cm), for example 2 inches (5.13 cm). However, the sizes, shapes, numbers and spacing arrangement of these holes may vary without departing from the spirit and scope of the present invention.

Figure 14:
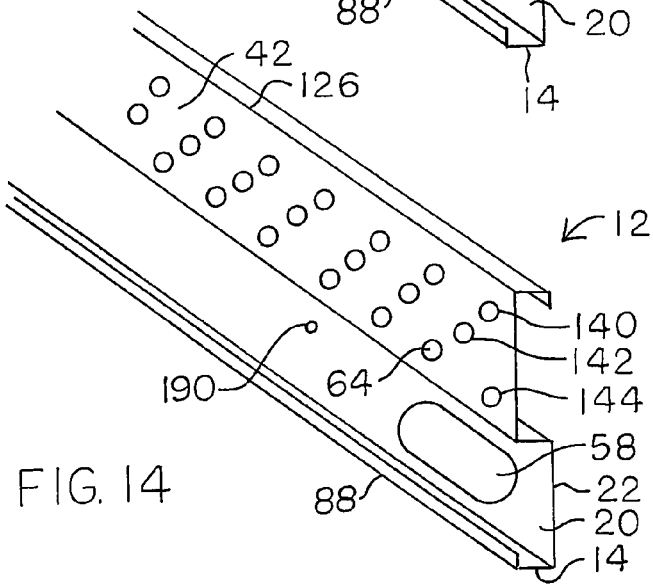
FIG. 14 is a partial perspective view of a roof truss member used in the invention.

In an embodiment shown in FIG. 14, embedded portion 42 (as shown with roof truss member 12) includes a first row 140 of equally spaced, circular expansion holes 64, a second row 142 of equally spaced, circular expansion holes 64, and a third row 144 of equally spaced, elongated or oval expansion holes 64 extending along a length of embedded portion 42. Second row 142 can be offset with respect to first and third rows 140 and 144 respectively. Each expansion hole 64 of rows 140, 142 and 144 of circular expansion holes 64 can have a radius of about 0.1 inches (0.25 cm) to about 1 inch (2.5 cm), for example 0.75 inches (1.9 cm). However, the sizes, shapes, numbers and spacing arrangement of expansion holes 64 can vary without departing from the spirit and scope of the present invention.

Figure 15:
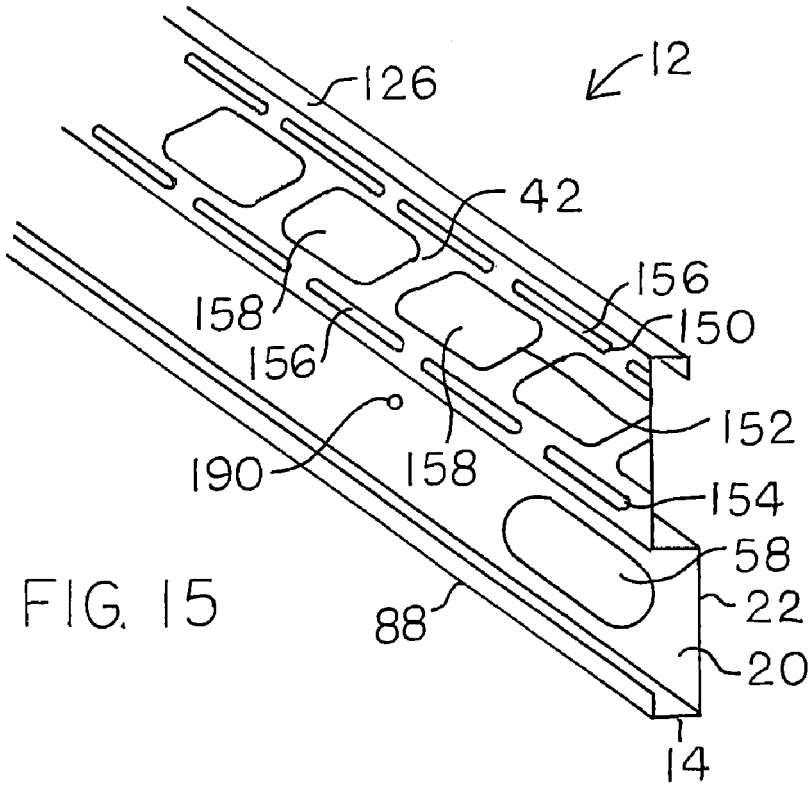
FIG. 15 is a partial perspective view of a roof truss member used in the invention.

In an embodiment shown in FIG. 15, embedded portion 42 (as shown with roof truss member 12) includes a first row 150 of elongated or rectangular expansion holes 156, a second row 154 of elongated or rectangular holes 156 and a row 152 of generally trapezoidally shaped expansion holes 158 positioned between the first row 150 of elongated holes 156 and the second row 154 of elongated holes 156. Each row extends along a length of embedded portion 42. Each hole of the first and second rows 150 and 154 of elongated holes 156 can have a length of about 2 inches (5 cm) to about 2.8 inches (7 cm), for example about 2.5 inches (6.4 cm), and a width of about 0.2 inches (0.5 cm) to about 0.8 inches (2 cm), for example about 0.50 inch (1.3 cm). Each of the trapezoidally shaped elongated holes 158 can have an area of about 1.6 $in^2$ (10 $cm^2$) to about 9.3 $in^2$ (60 $cm^2$), for example 6.7 $in^2$ (43 $cm^2$). However, the sizes, shapes, numbers and spacing arrangement of these holes may vary without departing from the spirit and scope of the present invention.

Figure 16:
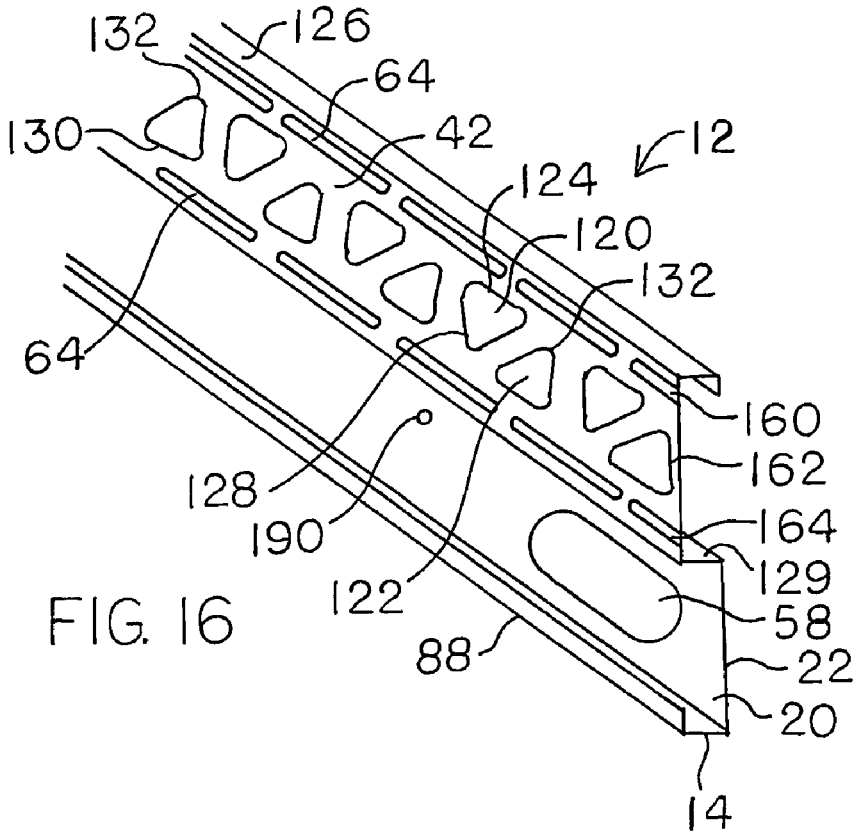
FIG. 16 is a partial perspective view of a roof truss member used in the invention.
Figure 17:
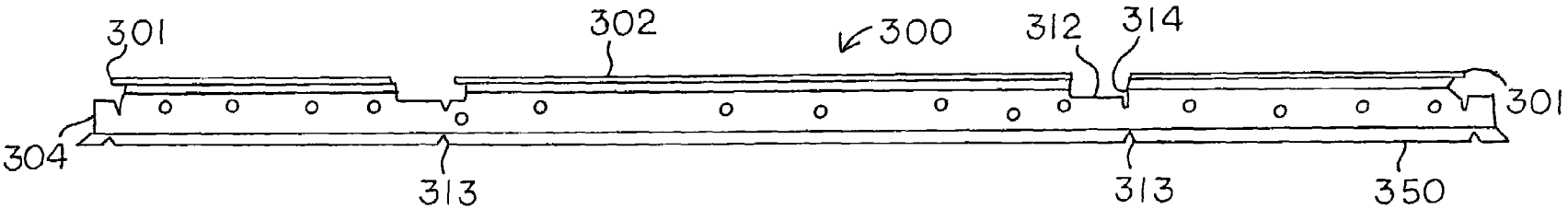
FIG. 17 is a side elevation view of a support bar used in the invention.
Figure 18:
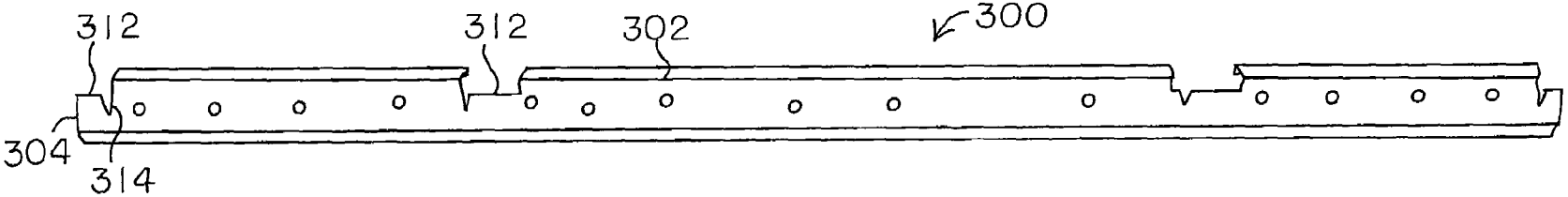
FIG. 18 is a side elevation view of a support bar used in the invention.
Figure 19:
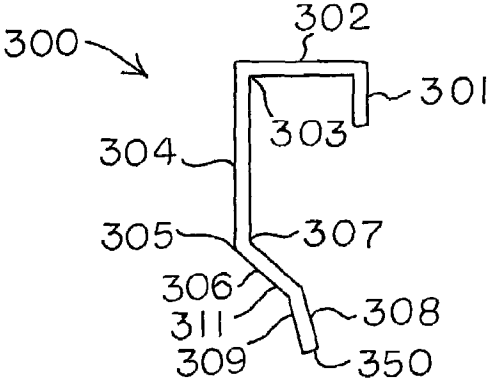
FIG. 19 is a front elevation view of a support bar used in the invention.
Figure 20:
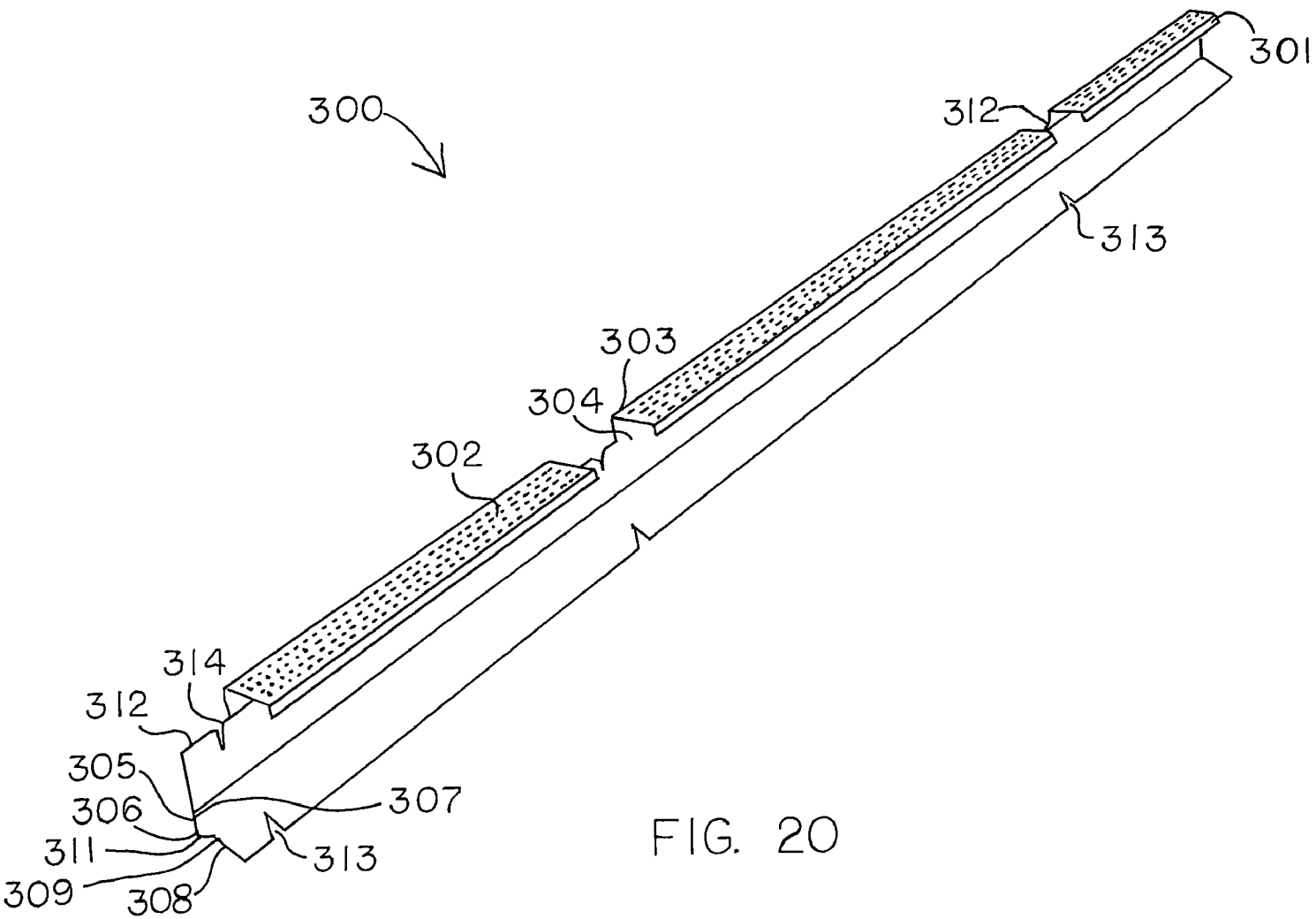
FIG. 20 is a perspective view of a support bar used in the invention.

In an embodiment shown in FIG. 16, embedded portion 42 (as shown with roof truss member 12) includes a first row 160 of elongated or oval expansion holes 64, a second row 162 of generally alternating first triangular expansion holes 120 and second generally triangular expansion holes 122, a third row 164 of elongated or oval expansion holes 64. Each row of holes extends along a length of embedded portion 42. Each hole 64 of first row 160 of elongated or oval expansion holes 64 and the third row 164 of elongated or oval expansion holes 64 can have a length of about 5.5 inches (14 cm) to about 6.3 inches (16 cm), for example 6 inches (15.2 cm), and a width of about 0.10 inches (0.25 cm) to about 0.4 inches (1 cm), for example about 0.25 inches (0.64 cm). However, the sizes, shapes, numbers and spacing arrangement of these expansion holes 64 can vary without departing from the spirit and scope of the present invention. First triangular holes 120 can include a base 124 positioned generally parallel to flange 126 and an apex 128 oriented toward intersecting edge 128. Second triangular holes 122 can include a base 130 positioned generally parallel to intersecting edge 128 and an apex 132 oriented toward flange 126. First triangular holes 120 and second triangular holes 122 can generally make up equilateral triangles with each edge of each triangular hole 120 and 122 having a length of about 1.6 inches (4 cm) to about 2.4 inches (6 cm), for example two inches (5.13 cm). However, the sizes, shapes, numbers and spacing arrangement of these holes may vary without departing from the spirit and scope of the present invention.

As shown in FIGS. 3 and 12-16, the member (roof truss member 12 or base member 24) that includes embedded portion 42 can have a "CC-type" configuration. An embodiment of this configuration is described with reference to FIG. 3, where first web 200 has a length of about 3.9 inches (10 cm) to about 4.7 inches (12 cm), for example 4.4 inches (11.1 cm). First flange 202 has a length of about 1.2 inches (3 cm) to about 2 inches (5 cm), for example about 1.6 inches (4.1 cm). The first return lip 204 has a length of about 0.2 inches (0.5 cm) to about 0.8 inches (2 cm), for example about 0.50 inch (1.3 cm). The second flange 206 has a length of about 1.2 inches (3 cm) to about 2 inches (5 cm), for example about 1.6 inches (4.1 cm). The second web 208 has a length of about 3.1 inches (8 cm) to about 3.9 inches (10 cm), for example about 3.6 inches (9.2 cm). The third flange 210 has a length of about 1.2 inches (3 cm) to about 2 inches (5 cm), for example about 1.6 inches (4.1 cm). The second return lip 212 has a length of about 0.20 inches (0.5 cm) to about 0.8 inches (2 cm), for example about 0.50 inch (1.3 cm). However, these lengths may vary in other embodiments/applications.

The member (roof truss member 12 or base member 24) that does not include embedded portion 42 can have a "C-type" configuration. An embodiment of this configuration is described with reference to FIG. 4, where first web 250 has a length of about 3.9 inches (10 cm) to about 4.7 inches (12 cm), for example 4.4 inches (11.1 cm). First flange 252 has a length of about 1.2 inches (3 cm) to about 2 inches (5 cm), for example about 1.6 inches (4.1 cm). First return lip 254 has a length of about 0.2 inches (0.5 cm) to about 0.8 inches (2 cm), for example about 0.50 inch (1.3 cm). Second flange 256 has a length of about 1.2 inches (3 cm) to about 2 inches (5 cm), for example about 1.6 inches (4.1 cm). Second return lip 262 has a length of about 0.20 inches (0.5 cm) to about 0.8 inches (2 cm), for example about 0.50 inch (1.3 cm). However, these lengths may vary in other embodiments/applications.

For pivoting or scissoring of the roof truss member versus the roof base member, the side of web 200 opposite first flange 202 and second flange 206 interfaces with the side of web 250 opposite first flange 252 and second flange 256.

Referring to FIGS. 17-20, and as was described above, connecting bar 300 creates a permanent lateral blocking and bracing member, which contributes to load carry capacity of the final roof design.

Referring to FIGS. 17-20, bar 300 has a cross-sectional shape that includes web 304, top flat portion 302, which extends generally perpendicularly from a first edge 303 of web 304. Return lip 301 extends from an end of top flat portion 302. A first end 305 of first bottom portion 306 extends from a second end 307 of web 304 and a first end 309 of second bottom potion 308 extends from a second end 311 of first bottom portion 306. Web 304 forms an angle with first bottom portion 306 that is generally greater than 90 degrees. When the plane of second bottom portion 306 is extended to web 304, the angle formed is greater than the angle formed with first bottom portion 306.

Web 304 has a length of about 3.9 inches (10 cm) to about 4.7 inches (12 cm), for example 4.4 inches (11.1 cm). Top plat portion has a length of about 0.5 inches (1.3 cm) to about 2 inches (5 cm), for example about 1.25 inches (3.2 cm). Return lip 301 has a length of about 0.2 inches (0.5 cm) to about 0.8 inches (2 cm), for example about 0.50 inch (1.3 cm). First bottom portion 306 has a length of about 0.5 inches (1.3 cm) to about 2 inches (5 cm), for example about 1.25 inches (3.2 cm). Second bottom portion 306 has a length of about 0.25 inches (0.64 cm) to about 1.5 inches (3.8 cm), for example about 1 inch (2.5 cm). However, these lengths may vary in other embodiments/applications.

Second bottom portion 306 includes a plurality of stud engagers in the form of notches 313, which open to the longitudinal or laterally outer edge of second bottom portion 306. The notches 313 are formed to a depth from the edge of about 0.25 inches (0.64 cm) to about 0.5 inches (1.3 cm) and in some cases about 0.375 inches (about 0.95 cm).

Portions of web 304 and corresponding portions of top plat portion 302 are cut out or otherwise removed to form truss openings 312. Openings 312 are spaced along bar 300 to correspond with the distance, spacing and width of roof truss members 12, roof base members 24, roof truss connector 54 or roof truss connector 56. As such, the length of openings 312 can be about 1.33 inches (3.4 cm) to about 2.25 inches (5.7 cm), for example about 1.75 inches (4.4 cm). The depth of openings 312 (the length from top plat portion to the remaining portion of web 304 is such that the depth of the remaining portion of web 304 corresponds with the width of support openings 61 and 58. Thus, the depth of the remaining portion of web 304 can be about 1 inch (2.5 cm) to about 3 inches (7.6 cm) in some cases about 1.75 inches (4.4 cm) to about 2.5 inches (6.4 cm) and in other cases about 2.25 inches (5.7 cm).

Web notches 314 extend into web 304 at an end of openings 312. The location or web notches 314 corresponds to the location of notches 313. Web notches 314 are formed to a depth from the bottom of opening 314 into the remaining portion of web 304 about 0.25 inches (0.64 cm) to about 0.5 inches (1.3 cm) and in some cases about 0.375 inches (about 0.95 cm).

Figure 21:
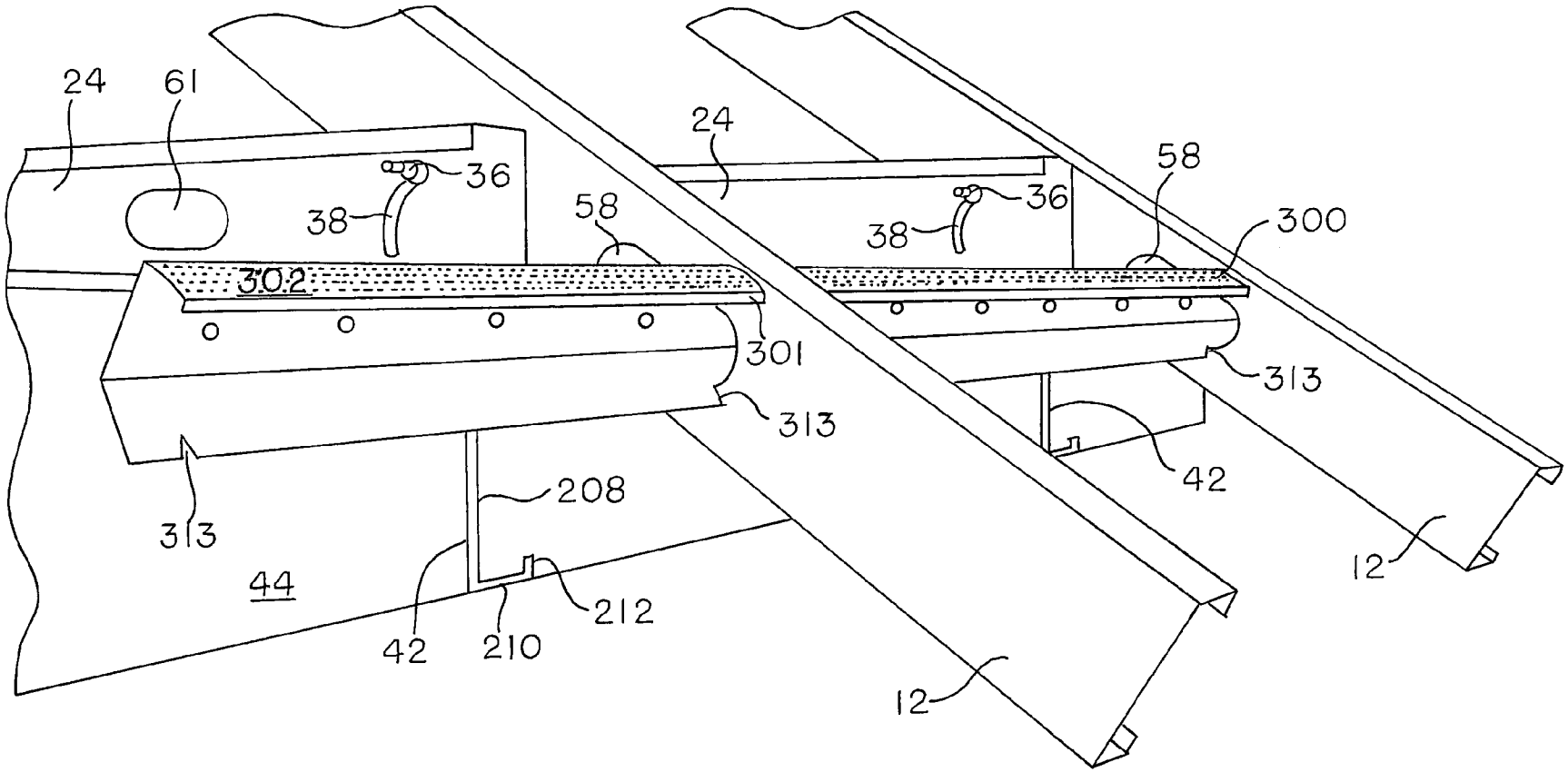
FIG. 21 is a partial perspective view of a roof truss system including support bar according to the invention.
Figure 22:
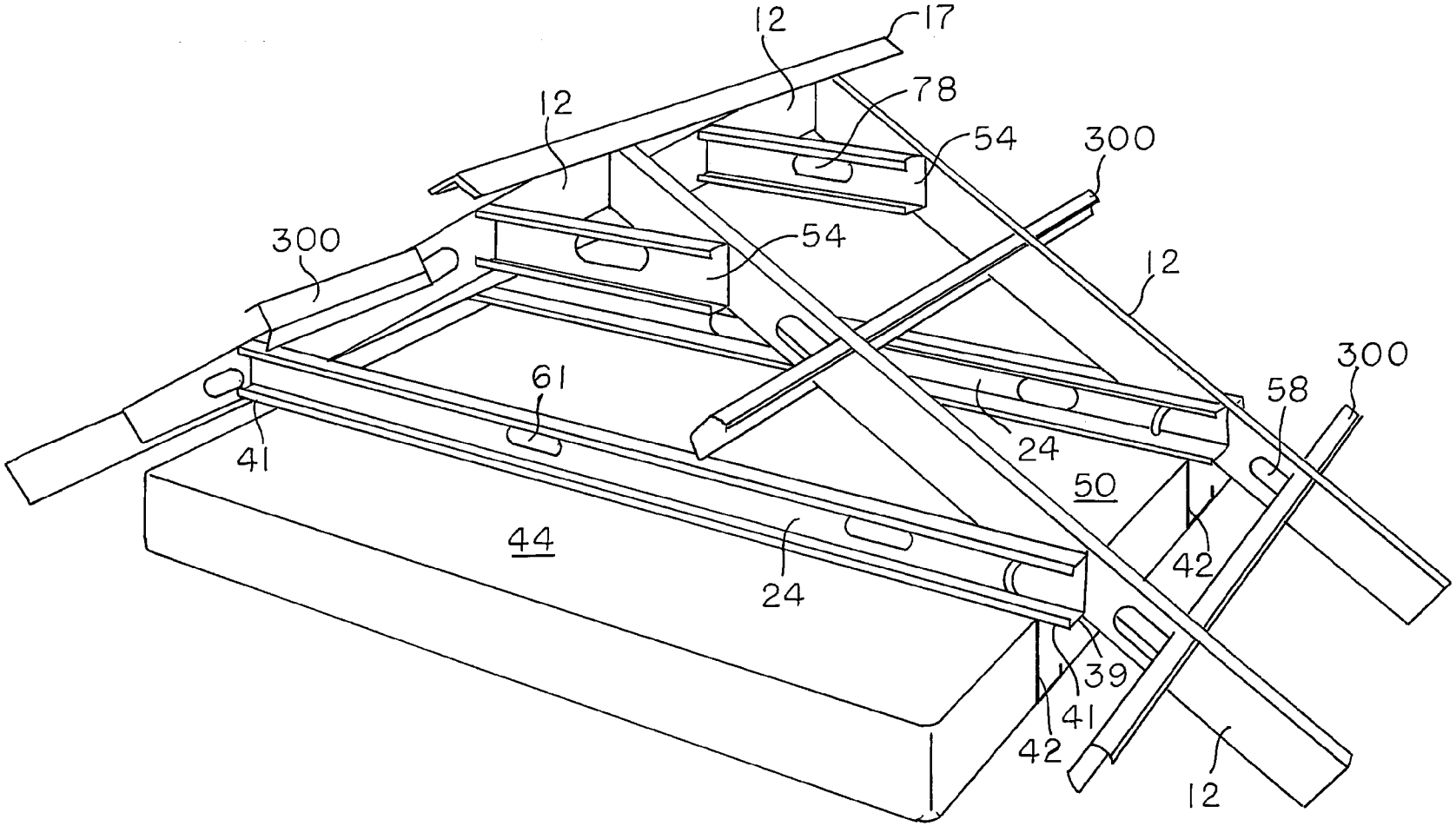
FIG. 22 is a perspective view of a roof truss system including support bars according to the invention.

As shown in FIG. 21, web notches 314 are laterally aligned with corresponding notches 313. The pairs of laterally aligned notches 313 and 314, as opposed to a single notch, provide two areas of contact with web 200 or 250 of a roof truss member 12 or roof base member 24. The two areas of contact enhance the grip of bar 300 on web 200 or 250 of a roof truss member 12 or roof base member 24 and aids in preventing roof truss member 12 or roof base member 24 from pivoting or twisting, thus adding greater stability to roof truss system 10 (FIGS. 21 and 22).

Referring now to FIGS. 17-20, each notch 313 and 314 is formed by a slot inclined relative to the longitudinal axis of bar 300, wherein the angle and the width of the notch 313 and 314 cooperate to bind the webs 200 or 250 of the roof truss member 12 or roof base member 24 in the notches 313 and 314. Notches 313 and 314 can have a width of about 0.065 inch (about 0.16 cm) to about 0.080 inch (about 0.20 cm), and may be angled about five and a half degrees to about eight degrees relative to a perpendicular 60 to the longitudinal axis of bar 300. In some embodiments, notches 313 and 314 are angled about seven degrees and have a width of about 0.080 inch (about 0.20 cm).

Notches 313 and 314 generally have parallel sides that are straight. However, other configurations are contemplated. For example, notched 313 and 314 can have curved parallel sides.

In embodiments of the invention, bar 300 is made of eighteen to fourteen gauge metal. The width and angle provide notches 313 and 314 which can fit twenty gauge roof truss member 12 or roof base member 24, to fit eighteen gauge roof truss member 12 or roof base member 24 with a slight bind, and to fit sixteen gauge roof truss member 12 or roof base member 24 tightly, which may cause webs 200 and 250 of the roof truss member 12 or roof base member 24 to bend slightly with notches 313 and 314.

Notches 313 and 314 can fit fourteen gauge roof truss member 12 or roof base member 24, with a tight fit. The tighter fit with heavier gauge roof truss member 12 or roof base member 24 is desired as usually they are used to bear higher loads.

The top flat portion 302 of bar 300 creates a screw surface for the horizontal attachment of roof sheathing. Generally, when installed with roof truss member 12, top flat portion 302 of bar 300 is approximately parallel to top edge 30 of roof truss member 12. Also, the use of bar 300 with roof truss member 12, roof base member 24, top connection plate 54 and lower connection plate 70 greatly reduces the amount of fasteners required and creates a friction fit snap together, thermal efficient, field erected truss system.

Bar 300 is installed into roof truss system 10 by sliding bar 300 into aligned openings 58, 61 or 78 until notches 313 and 314 align with the desired web. Bar 300 is then rotated allowing notches 313 and 314 to engage the web until top flat portion 302 is generally parallel a top edge of the web and/or terminal end 350 of bar 300 contacts a flange of the member bar 300 has been inserted into.

Figure 24:
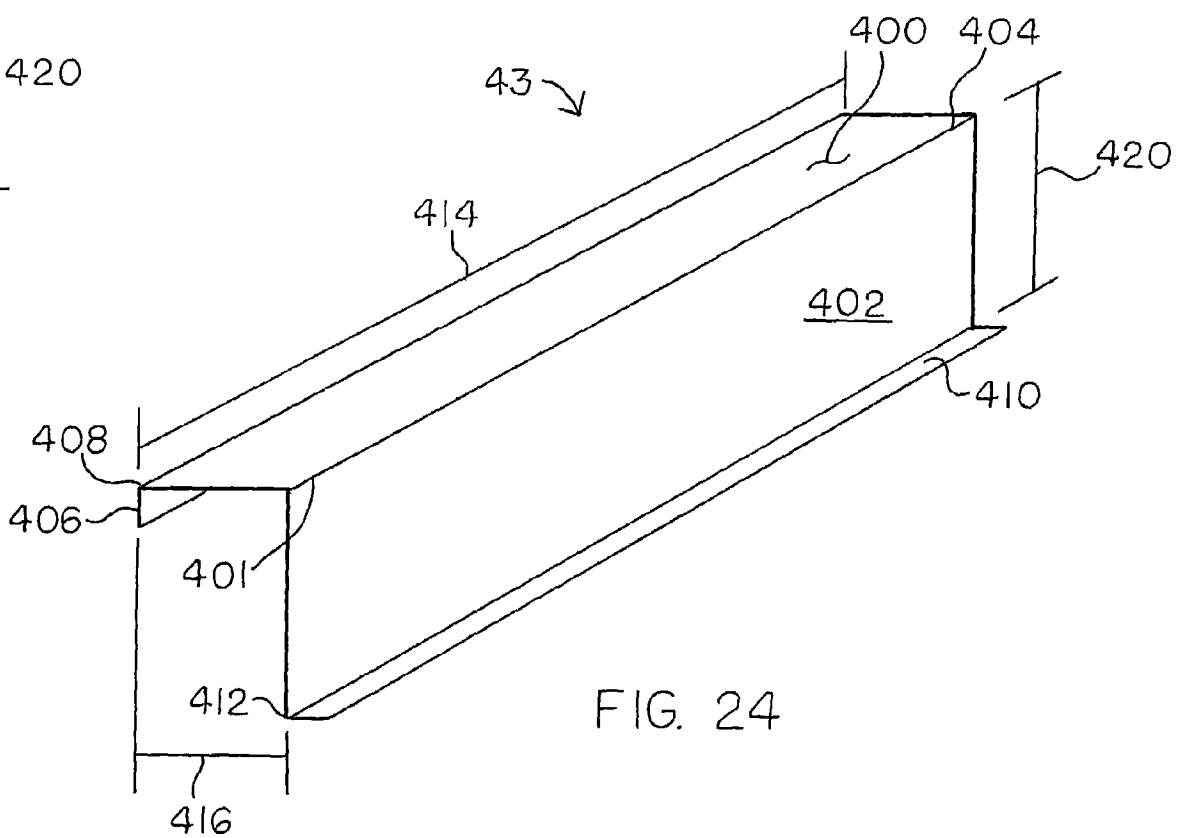
FIG. 24 is a perspective view of a mating cap used in the present invention.
Figure 23:
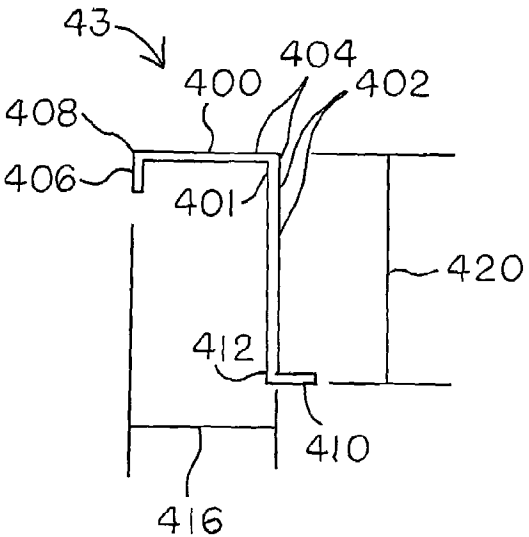
FIG. 23 is an end elevation view of a mating cap used in the present invention.

As shown in FIG. 1, wall 52 is adapted to receive roof truss system 10 thereon, by first placing mating cap 43 along a top surface of wall 52. As shown in FIGS. 23 and 24, mating cap 43 includes a side web 402, first edge 401 of which extends approximately perpendicular from first edge 404 of top web 400, a gripping flange 406 extending approximately perpendicular from second edge 408 of top web 400 and approximately parallel to side web 402, and holding flange 410 extending approximately perpendicular from second edge 412 of side web 402.

Mating cap 43 typically has a length 414 approximately equal to the length of wall 52. Top web 400 as a width 416 approximately equal to the width of wall 52, such that top web 400 can sit along the top surface of wall 52 and the edges defined by gripping flange 406, top web 400, and side web 402 form a tight fit sliding over the outer surfaces of wall 52.

Referring to FIG. 1, when mating cap 43 is placed on wall 52, the space defined by side web 402 and holding flange 410 is adapted to receive receiving space 41 of roof base member 24 such that an edge of central body 44 is in contact with side web 402 and holding flange 410 is in contact with bottom surface 62 of central body 44.

Referring again to FIGS. 23 and 24, the length 420 of side web 402 is approximately equal to thickness 15 of central body 44.

Mating cap 43 can be made from any suitable material. Non-limiting examples of which include, construction grade plastics, composite materials, ceramics, combinations thereof, and the like. Suitable metals include, but are not limited to, aluminum, steel, stainless steel, tungsten, molybdenum, iron and alloys and combinations of such metals. In various particular embodiments of the invention, mating cap 43 is made of a light gauge metal.

The present roof truss panels 50 can be made using batch shape molding techniques. However, this approach can lead to inconsistencies and can be very time intensive and expensive.

In an embodiment of the invention, the present roof truss panels 50 can be made using an apparatus for molding a semi-continuous or continuous foamed plastic element that includes a) a mold including:

i) a bottom wall, a pair of opposite side walls and a cover, and ii) a molding seat, having a shape mating that of the element, defined in the mold between the side walls, the bottom wall and the cover;

b) means for displacing the cover and the side walls of the mold towards and away from the bottom wall to longitudinally close and respectively open the mold; and c) first means for positioning in an adjustable manner said cover away from and towards said bottom wall of the mold to control in an adjustable and substantially continuous manner the height of the molding seat.

The apparatus is configured to include the partially embedded members (roof truss members 12 or roof base members 24) described above. As a non-limiting example, the methods and apparatus disclosed in U.S. Pat. No. 5,792,481 can be adapted to make roof truss panels 50 of the present invention. The relevant parts of U.S. Pat. No. 5,792,481 are incorporated herein by reference.

The present invention also provides a method of constructing a building that includes providing a slab or foundation having a series of walls extending vertically therefrom having top surfaces and attaching the above-described roof truss system to the top surfaces.

The present invention further provides buildings constructed according to the above-described method.

The present invention is additionally directed to buildings that include the above-described roof truss system.

The present invention also provides a method of constructing a building that includes providing a slab or foundation having a series of walls extending therefrom, the walls including a top surface; and attaching the above-described roof truss system to the top surfaces.

The present invention further provides buildings that include the above-described roof truss system and/or are constructed according to the above-described method.

When the present roof truss system is assembled (with or without the above-described bracing bars, roofing materials are typically attached to the roof facing edge of the roof truss members and/or the top flat portion of the bracing bars.

As such, roof decking surfaces such as a plywood, composite sheeting, gypsum board, cement board, wood, sheet metal or other suitable support structure can be attached to the roof facing edge of the roof truss members and/or the top flat portion of the bracing bars. When appropriate, fiber-glass matting and suitable roof underlayment, such as felt can cover all or part of the roof decking. Roofing materials can be attached to the roof decking and/or roof facing edge of the roof truss members and/or the top flat portion of the bracing bars as appropriate. Non-limiting examples of such roofing materials include, asphalt shingles, plastic molded or extruded shingles, non-asphalt composite shingles, rubber based shingles, rubber-based roofing systems, asphalt based roofing systems, tar based roofing systems, steel shingles, steel standing seam roofing systems, steel corrugated panel roofing systems, aluminum standing steam roofing systems, aluminum shingles, aluminum corrugated panel roofing systems, clay tiles, lightweight concrete roofing shingles and cement tiles.

While the present invention has been described in conjunction with the specific embodiments set forth above, many alternatives, modifications and other variations thereof will be apparent to those of ordinary skill in the art. All such alternatives, modifications and variations are intended to fall within the spirit and scope of the present invention.

What is claimed is:

1. An adjustable composite roof truss comprising:

one or more roof truss members that include a pivot end, a connection end, a roof facing edge, an inside edge, and a pivot surface;

one or more roof base members that include a receiving end, a connecting end, a top edge, a bottom edge, and a contact surface; and one or more central bodies, substantially parallelepipedic in shape, comprised of an expanded polymer matrix, having opposite faces, a first surface and an opposing second surface;

wherein the roof truss members are pivotally connected to the roof base members by a pivot fastener inserted through a pivot opening positioned between a midpoint and the receiving end along the contact surface of the roof base members and a stator opening located between a midpoint and the pivot end of the roof truss members;

wherein the roof base members include an embedded portion extending from the roof facing edge or the bottom edge respectively such that the embedded portion longitudinally extends across and into a central body;

wherein the roof base members include an exposed portion longitudinally extending above the central body; and wherein one or more expansion holes are positioned along the embedded portion between the first surface and the second surface of the central body such that the polymer matrix expands through the expansion holes.

2. The adjustable composite roof truss according to claim 1, wherein the roof truss members and roof base members pivot from a parallel orientation to an orientation where the roof truss members form and angle relative to the bass members.

3. The adjustable composite roof truss according to claim 1, wherein the central body has a thickness measured as the distance between the first surface and the second surface of from 2 cm to 30.5 cm.

4. The adjustable composite roof truss according to claim 1, wherein the expanded polymer matrix comprises one or more polymers selected from the group consisting of homopolymers of vinyl aromatic monomers; copolymers of at least one vinyl aromatic monomer with one or more of divinylbenzene, conjugated dienes, alkyl methacrylates, alkyl acrylates, acrylonitrile, and/or maleic anhydride; polyolefins; polycarbonates; and combinations thereof.

5. The adjustable composite roof truss according to claim 1, wherein the expanded polymer matrix comprises carbon black, graphite or a combination thereof.

6. The adjustable composite roof truss according to claim 1, wherein the expanded polymer matrix comprises an interpolymer of a polyolefin and in situ polymerized vinyl aromatic monomers.

7. The adjustable composite roof truss according to claim 1, wherein the roof truss members and/or the roof base members comprise a material selected from the group consisting of metal, construction grade plastics, composite materials, ceramics, and the like.

8. The adjustable composite roof truss according to claim 1, wherein the roof truss members and/or the roof base members comprise a metal selected from the group consisting of aluminum, steel, stainless steel, tungsten, molybdenum, iron and alloys and combinations of such metals.

9. The adjustable composite roof truss according to claim 1, wherein one or more surfaces of the roof truss members and/or the roof base members have a texturized surface.

10. The adjustable composite roof truss according to claim 1, wherein the embedded portion of the roof base members extends through the first surface and terminates at least 1 cm from the second surface of the central body.

11. The adjustable composite roof truss according to claim 1, wherein the embedded portion of the roof base members extends through the first surface and terminates substantially flush with the second surface of the central body.

12. The adjustable composite roof truss according to claim 1, wherein the roof base members further comprise one or more support openings along the pivot surface and/or contact surface respectively.

13. The adjustable composite roof truss according to claim 12, wherein the support openings are adapted to receive a connecting bar extending from a first roof truss member or a first roof base member to a second roof truss member or a second roof base member respectively.

14. The adjustable composite roof truss according to claim 13, wherein the connecting bar has a cross-sectional shape that includes a web, a top flat portion extending perpendicularly from a first edge of said web, a first bottom portion extending from a second edge of said web, and a second bottom portion extending from an end of the first bottom portion.

15. The adjustable composite roof truss according to claim 12, wherein the support openings are adapted to receive utility lines.

16. The adjustable composite roof truss according to claim 15, wherein the utility lines are one or more selected from the group consisting of water lines, waste lines, chases, telephone lines, cable television lines, antenna lines, electrical lines, ductwork, and gas lines.

17. The adjustable composite roof truss according to claim 1, wherein the expansion holes have a cross-sectional shape selected from the group consisting of round, oval, elliptical, square, rectangular, rounded rectangular, triangular, hexagonal, parallelogram, oblong, octagonal and combinations thereof.

18. A building comprising two or more of the adjustable composite roof trusses according to claim 1.

* * * * *